US005238800A

United States Patent [19]

Hosoi et al.

[11] Patent Number: 5,238,800

[45] Date of Patent: Aug. 24, 1993

[54] SILVER HALIDE PHOTOGRAPHIC LIGHT-SENSITIVE MATERIAL IMPROVED IN ANTI-JAMMING PROPERTY

[75] Inventors: Yuji Hosoi; Junichi Fukawa, both of Hachioji; Akira Kobayashi, Hino, all of Japan

[73] Assignee: Konica Corporation, Tokyo, Japan

[21] Appl. No.: 795,395

[22] Filed: Nov. 21, 1991

[30] Foreign Application Priority Data

Nov. 21, 1990 [JP] Japan ..... 2-316778

[51] Int. Cl.[5] ..... G03C 1/85

[52] U.S. Cl. ..... 430/527; 430/264; 430/496; 430/530

[58] Field of Search ..... 430/527, 264, 496, 530

[56] References Cited

U.S. PATENT DOCUMENTS

| | | | |
|---|---|---|---|
| 4,126,467 | 11/1978 | Miyazako et al. | 430/528 |
| 4,263,397 | 4/1981 | Horikoshi et al. | 430/496 |
| 4,266,003 | 5/1981 | Ikeda et al. | 430/264 |
| 4,999,276 | 3/1991 | Kuwabara et al. | 430/264 |
| 5,004,669 | 4/1991 | Yamada et al. | 430/264 |
| 5,013,637 | 5/1991 | Tsukada | 430/527 |
| 5,026,622 | 6/1991 | Yamada et al. | 430/264 |
| 5,079,136 | 1/1992 | Tachibana et al. | 430/527 |
| 5,122,445 | 6/1992 | Ishigaki | 430/527 |

FOREIGN PATENT DOCUMENTS

| | | | |
|---|---|---|---|
| 0367573A1 | 5/1990 | European Pat. Off. . | |
| 0059650 | 3/1991 | Japan | 430/527 |
| 203249A | 5/1980 | United Kingdom . | |
| 2092768 | 8/1982 | United Kingdom | 430/527 |

*Primary Examiner*—Charles L. Bowers, Jr.
*Assistant Examiner*—Thomas R. Neville
*Attorney, Agent, or Firm*—Finnegan, Henderson, Farabow, Garrett & Dunner

[57] ABSTRACT

Disclosed is a silver halide photographic light-sensitive material that comprises a support having thereon at least one silver halide light-sensitive emulsion layer, wherein emulsion layer is spectrally sensitized; the back coating layer side of said light-sensitive material has a specific surface resistance of 1 ¥ $10^9$ to 1 ¥ $10^{12}$ Ωat 25° C. and 25% RH; and said light-sensitive photographic material curls in the direction of said back coating layer side. The silver halide photographic light-sensitive material according to this invention does not undergo jamming even in electrostatic charge adsorption type cameras, and is improved in anti-static property.

3 Claims, No Drawings

SILVER HALIDE PHOTOGRAPHIC LIGHT-SENSITIVE MATERIAL IMPROVED IN ANTI-JAMMING PROPERTY

FIELD OF THE INVENTION

The present invention relates to a silver halide photographic light-sensitive material improved in anti-static property, specifically to a silver halide photographic light-sensitive material for use in printing and photoengraving.

BACKGROUND OF THE INVENTION

It is known that plastic films readily get electrified, which eventually limits their applications. In the photographic industry, polyethylene terephthalate films are commonly employed as the supports of silver halide light-sensitive materials. However, polyethylene terephthalate films tend to be electrified at a low humidity condition such as the wintertime. Electrification of plastic supports poses serious problems especially in the case of high-speed application of a high-speed emulsion or exposure and processing of a highly sensitive light-sensitive material by means of an automatic printer. Anti-static treatment is, therefore, a matter of crucial importance in the industry.

When a light-sensitive material is electrostatically charged, static marks tend to be formed on its surface due to electrical discharge, and foreign matters such as dust are likely to stick to its surface, allowing pinholes to be formed. Removal of such static marks and pinholes is very difficult and time-consuming. For enhanced productivity, it is of crucial importance not to allow static marks and pinholes to be formed, and for this purpose, an anti-static agent is generally employed in a light-sensitive material. Examples of anti-static agents that have recently been employed include fluorine-containing surfactants, cation surfactants, amphoteric surfactants, polyethylene oxide group-containing surfactants, polyethylene oxide group-containing polymers, and polymers containing a sulfonic group or a phosphoric group in each molecule. Generally, a layer containing such anti-static agent is provided on the back coating side of a light-sensitive material.

Some of newly developed cameras for printing and photoengraving (e.g., C-880 manufactured by Dainippon Screen Co., Ltd.) are so designed that electrostatic charges are allowed to be adsorbed onto the back coating layer of a film, then the film is wound around the drum of the camera, followed by exposure to light. In the case of such camera, provision of an anti-static layer on the back coating side of a film may result in insufficient winding of the film (jamming).

SUMMARY OF THE INVENTION

The object of the invention is to provide a silver halide photographic light-sensitive material which is improved in anti-static property, and, free from jamming even when employed in electrostatic charge adsorption type cameras.

The above object can be attained by a silver halide light-sensitive photographic light-sensitive material comprising a support and provided thereon at least one silver halide light-sensitive emulsion layer, wherein said emulsion layer is spectrally sensitized; the back coating side of said light-sensitive material has a specific surface resistance of $1\times10^9$ to $1\times10^{12}\Omega$ at 25° C. and 20% RH; and said light-sensitive material curls in the direction of said back coating side.

As stated above, in the case of electrostatic charge adsorption type cameras, provision of an anti-static layer on the back coating side hinders smooth winding of a light-sensitive material around the drum at the time of exposure, thus causing jamming. The inventors of the invention made extensive studies, and have found that the above problem can be solved by allowing a light-sensitive material to curl in the direction of its back coating side, and by allowing an anti-static layer to have a specific surface resistance.

The present invention will be explained in more detail.

The expression that "a light-sensitive material curls in the direction of the back coating side" means that the edge of a light-sensitive material turns up when the light-sensitive material is placed with its back coating side upward. "Curling" as referred to herein means both inherent curling of a light-sensitive material and curling made by rolling up a light-sensitive material. Curling of a light-sensitive material is examined by the following method: A specimen ($10\times100$ mm) is cut out from a roll of an unexposed light-sensitive material in such a manner that the long sides of the specimen are in the direction of rolling. Then, the specimen is hung down with its one short side being fixed so that its long sides become vertical with respect to the floor. The distance between the lower end of the specimen and a line vertical to the floor is measured. In the invention, such distance is required to be 1 mm or longer, which means the specimen curls in the direction of the back coating side. It is preferred that the specimen still curl in the direction of the back coating side even after 4-hour storage at such a deteriorating condition as 25° C. and 20% RH.

The specific surface resistance of a light-sensitive material is measured by using a Tetra ohmmeter(R-503, manufactured by Kawaguchi Electric Co.) after 2-hour moisture conditioning at 25° C. and RH20%. A light-sensitive material with a specific surface resistance exceeding $1\times10^{12}\Omega$ readily gets electrified. As state above, when a light-sensitive material is electrostatically charged, static marks tend to be formed on its surface or foreign matters such as dust tend to stick to its surface, resulting in the formation of pinholes. When the specific surface resistance is below $1\times10^9$, a light-sensitive material can be free of static marks or pinholes. But, if a light-sensitive material with such a low specific surface resistance is used for electrostatic charge adsorption type cameras that are normally employed for printing and photoengraving (e.g. C-880 manufactured by Dainippon Screen Co.), serious jamming may occur. To improve the anti-static property and anti-jamming property simultaneously, it is necessary to make the back coating side of a light-sensitive material have a specific surface resistance of $1\times10^9$ to $1\times10^{12}\Omega$. For that purpose, it is effective to provide an anti-static layer between a support and a back coating layer or between a support and a silver halide emulsion layer.

The following three methods are available for making a light-sensitive material curl in the direction of the back coating side. (1) By employing a larger amount of gelatin in the back coating side than in the emulsion layer side. In this case, it is preferable to make the gelatin amount ratio of the emulsion layer side to the back coating side less than 1.0. A more desirable result can be obtained when the gelatin content of the back coating side is 2.75 to 3.5 g/m$^2$; (2) By employing a suitable amount of a polymer latex or a matting agent in a light-sensitive material; and (3) By rolling a light-sensitive material up with the back coating side in, and leaving the resulting roll as it is for a period of time. A more desirable result can be obtained if such a roll of a light-sensitive material is subjected to heat treatment at 30° C. or higher.

The above methods can be employed in combination.

In the invention, an anti-static layer on the back coating side typically consists of a water-soluble conductive polymer, a hydrophobic polymer particles and a hardener, or consists of a metal oxide.

As the water-soluble conductive polymer, use can be made of a polymer containing at least one conductive group selected from a sulfonic acid group, a phosphoric acid ester group, a quaternary ammonium salt, a tertiary ammonium salt, a carboxyl group and a polyethylene oxide group. Of these conductive groups, a sulfonic acid group, a phosphoric acid ester group and a quaternary ammonium salt are preferable. The amount of such conductive group must be 5 wt % or more per molecule of the polymer. The water-soluble conductive polymer further contains a carboxy group, a hydroxy group, an amino group, an epoxy group, an aziridine group, an active methylene group, a sulfonic acid group, an aldehyde group or a vinylsulfone group. Of them, a carboxy group, a hydroxy group, an amino group, an epoxy group, an aziridine group and an aldehyde group are preferable. Such group is required to be present in the polymer in an amount of 5 wt % or more per molecule of the polymer. The molecular weight of the water-soluble conductive polymer is 3,000 to 100,000, preferably 3,500 to 50,000.

Examples of usable water-soluble conductive polymers are given below:

Homopolymer A-1

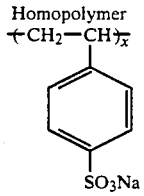

$\overline{M}n$ = 60,000

Homopolymer A-2

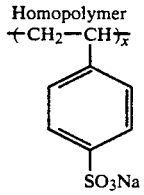

$\overline{M}n$ = 70,000

A-3

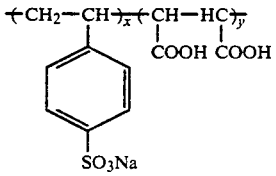

X:Y = 60:40
$\overline{M}n$ = 5,000

-continued

A-4

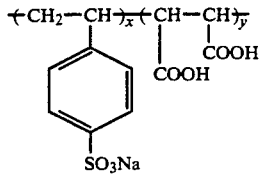

X:Y = 50:50
$\overline{M}n$ = 12,000

A-5

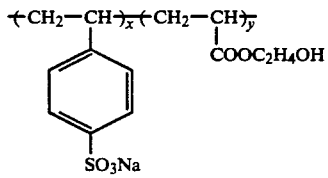

x:y = 70:30
$\overline{M}n$ = 5,000

A-6

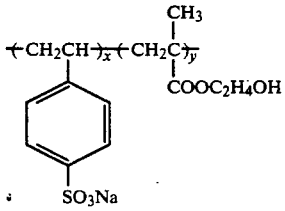

x:y = 90:10
$\overline{M}n$ = 10,000

A-7

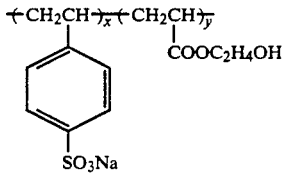

x:y = 60:40
$\overline{M}n$ = 7,000

A-8

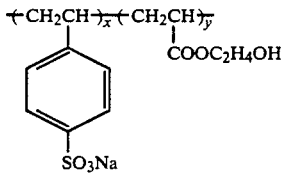

x:y = 60:40
$\overline{M}n$ = 7,000

A-9

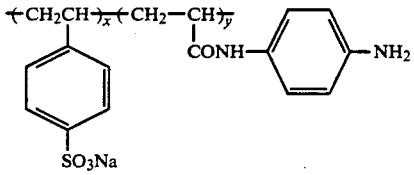

x:y = 90:10
$\overline{M}n$ = 15,000

A-10

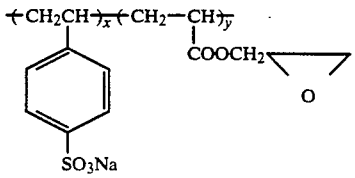

x:y = 60:40
$\overline{M}n$ = 5,000

-continued
A-11
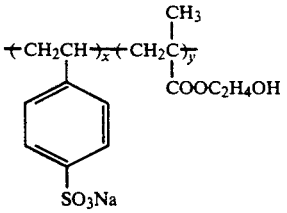
x:y = 90:10
$\overline{Mn}$ = 20,000
A-12
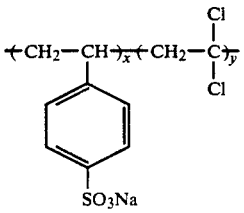
x:y = 97:3
$\overline{Mn}$ = 30,000
A-13
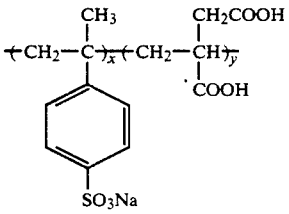
x:y = 98:2
$\overline{Mn}$ = 5,000
A-14
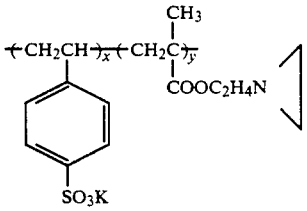
x:y = 60:40
$\overline{Mn}$ = 8,000
A-15
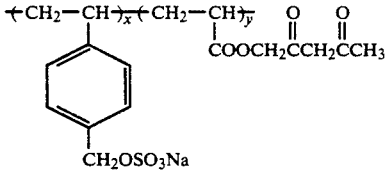
x:y = 95:5
$\overline{Mn}$ = 25,000
A-16
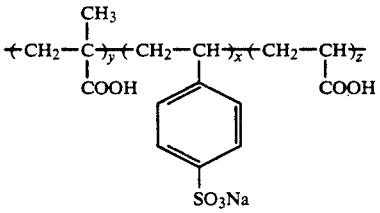
x:y:z = 80:19:1
$\overline{Mn}$ = 5,000
-continued
A-17
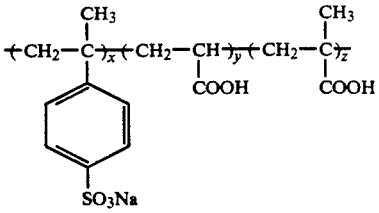
x:y:z = 70:28:2
$\overline{Mn}$ = 6,000
A-18
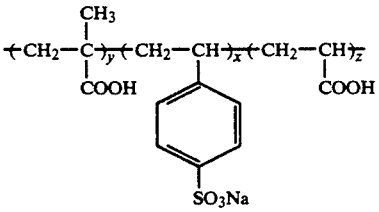
x:y:z = 85:13:2
$\overline{Mn}$ = 8,000
A-19
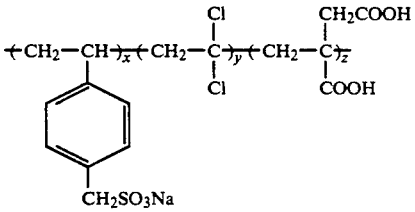
x:y:z = 80:16:4
$\overline{Mn}$ = 10,000
A-20
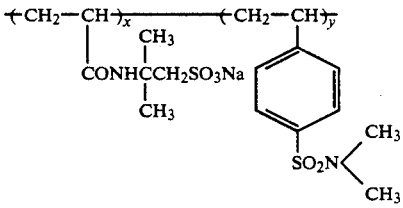
x:y = 90:10
$\overline{Mn}$ = 30,000
A-21
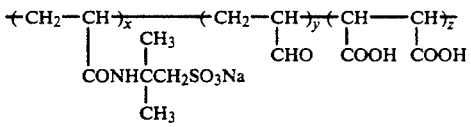
x:y:z = 85:10:5
$\overline{Mn}$ = 10,000
A-22
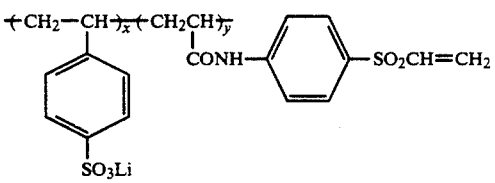
x:y = 90:10
$\overline{Mn}$ = 6,000
A-23
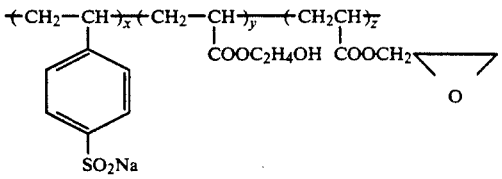

-continued x:y:z = 80:10:10
$\overline{Mn}$ = 15,000

Dextran sulfate — A-24
Degree of substitution 2.0
$\overline{Mn}$ = 100,000

A-25

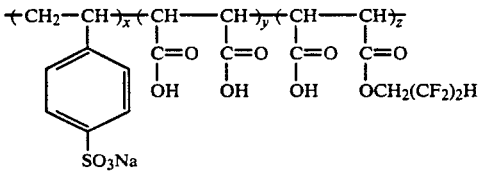

x:y:z = 50:40:10
$\overline{Mn}$ = 100,000

A-26

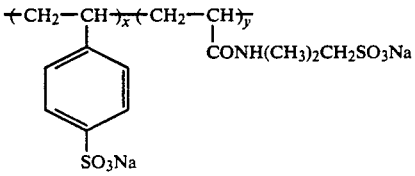

x:y = 80:20
$\overline{Mn}$ = 50,000

A-27

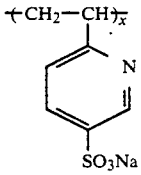

$\overline{Mn}$ = 100,000

A-28

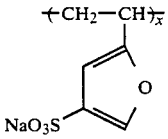

$\overline{Mn}$ = 20,000

A-29

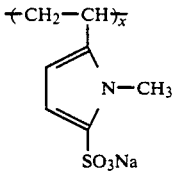

$\overline{Mn}$ = 20,000

A-30

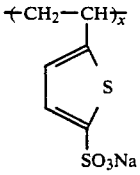

$\overline{Mn}$ = 150,000

A-31

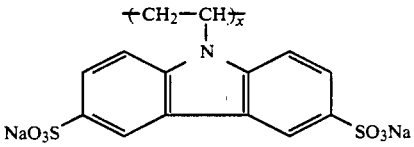

$\overline{Mn}$ = 300,000

-continued

A-32

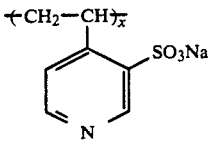

$\overline{Mn}$ = 280,000

A-33

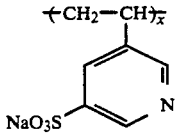

$\overline{Mn}$ = 50,000

A-34

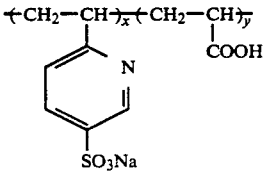

x:y = 60:40
$\overline{Mn}$ = 80,000

A-35

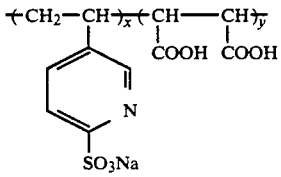

x:y 70:30
$\overline{Mn}$ = 5,000

A-36

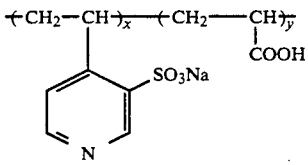

x:y = 80:20
$\overline{Mn}$ = 50,000

A-37

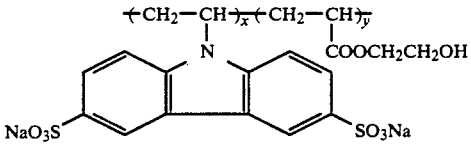

x:y = 75:25
$\overline{Mn}$ = 40,000

A-38

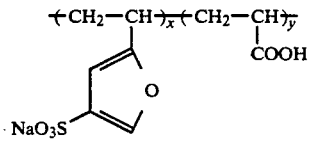

x:y = 80:20
$\overline{Mn}$ = 60,000

A-39

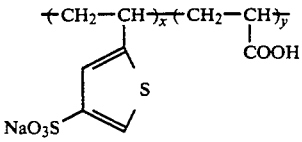

-continued x:y = 90:10
$\overline{Mn}$ = 40,000

A-40

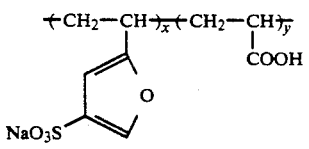

x:y = 55:45
$\overline{Mn}$ = 20,000

A-41

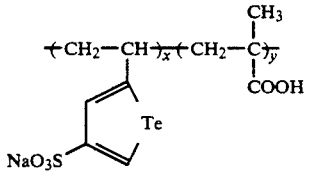

x:y = 90:10
$\overline{Mn}$ = 60,000

A-42

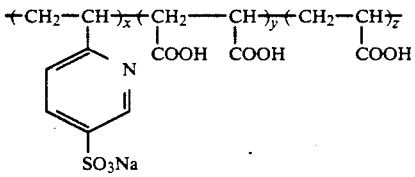

x:y:z = 80:10:10
$\overline{Mn}$ = 10,000

A-43

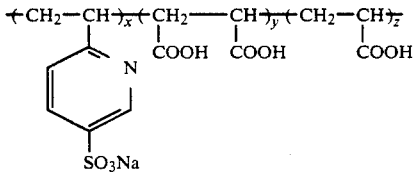

x:y:z = 70:25:5
$\overline{Mn}$ = 30,000

A-44

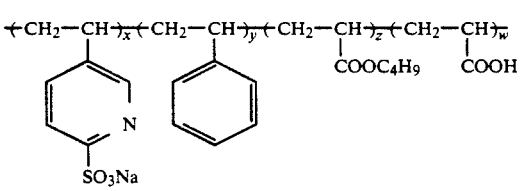

x:y:z:w = 60:30:8:2
$\overline{Mn}$ = 50,000

A-45

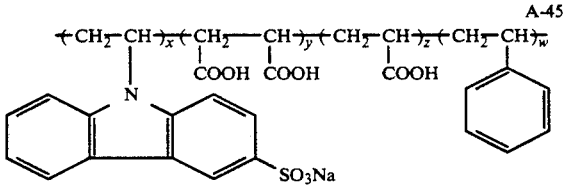

x:y:z:w = 50:30:10:10
$\overline{Mn}$ = 60,000

A-46

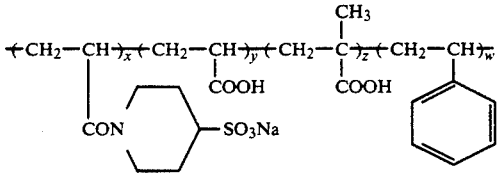

-continued x:y:z:w = 40:30:20:10
$\overline{Mn}$ = 50,000

A-47

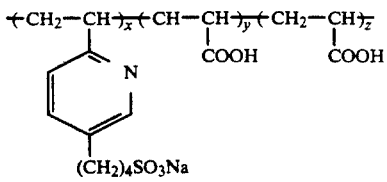

x:y:z = 60:30:10
$\overline{Mn}$ = 30,000

A-48

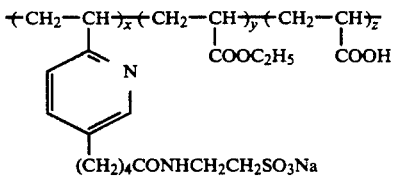

x:y:z = 80:5:15
$\overline{Mn}$ = 50,000

A-49

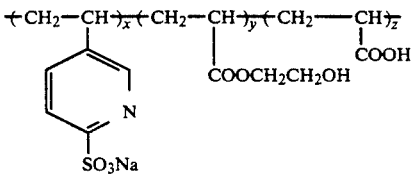

x:y:z = 55:35:10
$\overline{Mn}$ = 30,000

A-50

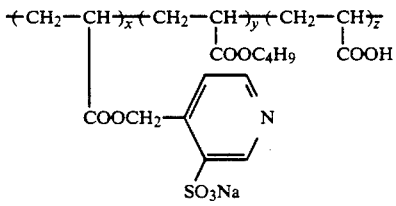

x:y:z = 50:10:40
$\overline{Mn}$ = 60,000

A-51

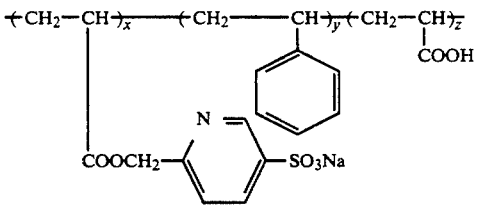

x:y:z = 60:10:30
$\overline{Mn}$ = 60,000

In the above Formulae A-1 to 50, x, y, z and w each represent the content of a monomeric unit (mol %), and $\overline{Mn}$ represents number average molecular weight.

These polymers can be prepared by subjecting monomers which are commercially available or can be synthesized by conventional methods to polymerization. These polymers are employed preferably in amounts of 0.01 to 10 g, more preferably 0.1 to 5 g, per square meter of the light-sensitive material.

These polymers are mixed with at least one hydrophilic or hydrophobic binder to form an anti-static layer. Gelatin and polyacrylamide are useful as the hydrophilic binder. Other usable hydrophilic binders include colloidal albumin, cellulose acetate, cellulose nitrate, polyvinyl alcohol, hydrolyzed polyvinyl acetate and gelatin phthalate. Usable hydrophobic binders are polymers with a number average molecular weight of 20,000 to 1,000,000. Examples of such polymers include styrene-butyl acrylate-acrylic acid ternary copolymers, butyl acrylate-acrylonitrile-acrylic acid ternary copolymers and methyl methacrylate-ethyl acrylate-acrylic acid ternary copolymers.

The hydrophobic polymer particles are contained in the water-soluble conductive polymer layer in the form of a water-insoluble latex. The hydrophobic polymer can be prepared by subjecting monomers selected from styrene, styrene derivatives, alkylacrylate, alkylmethacrylate, olefin derivatives, halogenated ethylene derivatives, acrylamide derivatives, methacrylamide derivatives, vinylester derivatives and acrylonitrile to polymerization. A hydrophobic polymer containing a styrene derivative, alkylacrylate or alkylmethacrylate in an amount of at least 30 mol %, preferably 50 mol % or more is especially useful in the invention.

A latex of the hydrophobic polymer can be obtained by subjecting the hydrophobic polymer to emulsion polymerization (the emulsion polymerization method) or by dissolving the hydrophobic polymer in the solid state in a low boiling solvent to allow it to be finely dispersed, followed by distillation-off of the solvent (the dispersion method). The former method is preferable since it permits the formation of small globules with a narrower size distribution. Emulsion polymerization is conducted preferably in the presence of an anionic or nonionic surfactant, which is employed in an amount of not more than 10 wt % relative to the amount of monomers. The use of a large amount of surfactant may cause the conductive layer to be opaque. The number average molecular weight of the hydrophobic polymer to be used in the invention is not limitative, as long as it is 3,000 or more. The molecular weight of the hydrophobic polymer has substantially no influence on the transparency of the support.

Specific examples of usable hydrophobic polymers are given below:

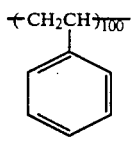

B-1

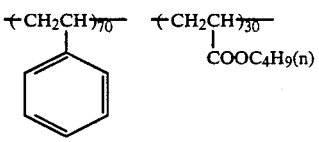

B-2

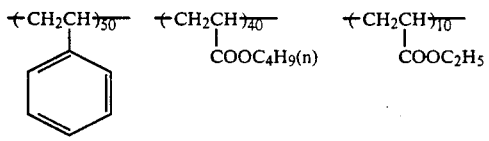

B-3

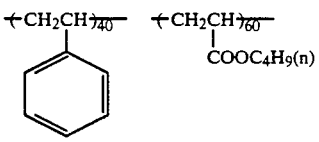

B-4

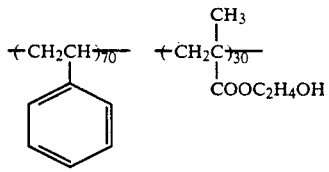

B-5

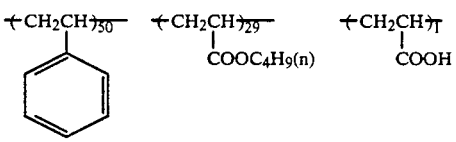

B-6

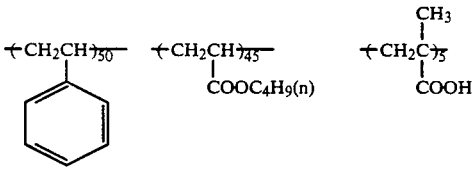

B-7

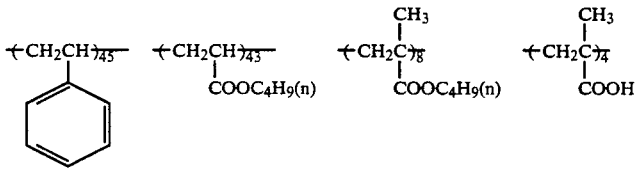

B-8

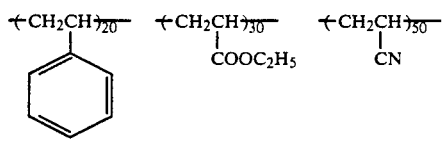

B-9

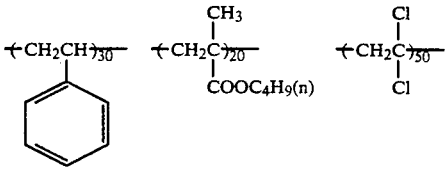

B-10

-continued

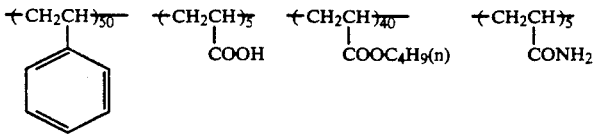

B-11

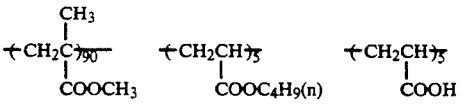

B-12

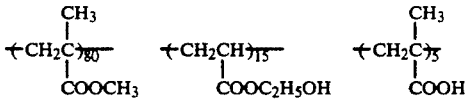

B-13

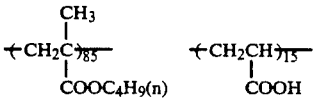

B-14

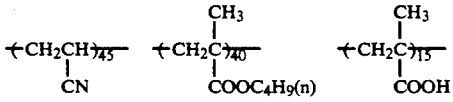

B-15

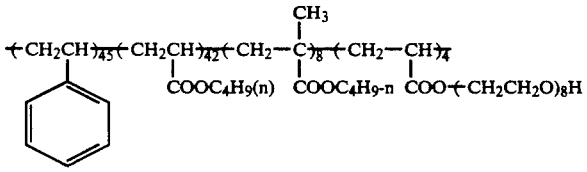

B-16

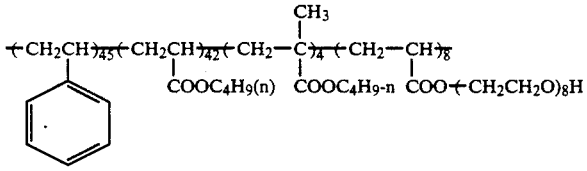

B-17

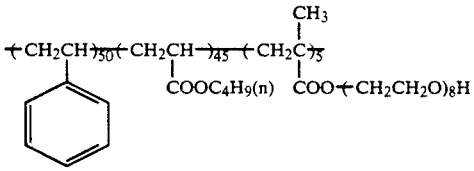

B-18

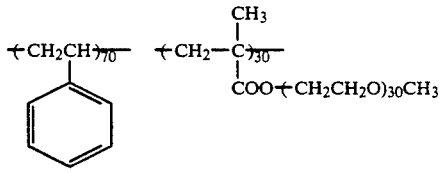

B-19

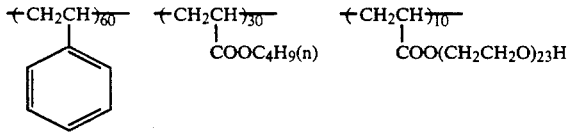

B-20

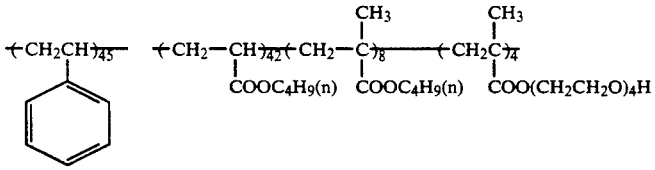

B-21

In B-1 to 21, the numbers in parentheses each indicate the amount of the monomeric unit (mol %).

The amount of the hydrophobic polymer is preferably 0.01 to 10 g, still preferably 0.1 to 5 g, per square meter of the light-sensitive material.

As an activator to be employed for the emulsion polymerization method, or as a dispersant to be employed in the dispersion method, nonionic activators, in particular, polyalkylene oxide compounds, are preferable. Here, a polyalkylene oxide compound is defined as a compound which contains 3 to 500 polyalkylene oxide chains in each molecule, and can be prepared, for example, by subjecting a polyalkylene oxide and an active hydrogen-containing compound (e.g. aliphatic alcohols, phenols, aliphatic acids, aliphatic mercaptanes, organic amides) to condensation, or by subjecting a polyol (such as polypropylene glycol, polyoxytetramethylene) and a compound such as an aliphatic mercaptane, an organic amine, ethylene oxide and propylene oxide to condensation.

The above polyalkylene oxide compound may be a block copolymer comprising two or more polyalkylene oxide segments. In this case, the total polymerization degree of the polyalkylene oxide segments is preferably 3 to 100. Representative examples of usable polyalkylene oxide compounds are given below:

| | Example Compound | |
|---|---|---|
| [Ao-1] | $HO(CH_2CH_2O)_nH$ | [n = 4] |
| [Ao-2] | $HO(CH_2CH_2O)_nH$ | [n = 15] |

-continued

Example Compound

[Ao-3] $HO(CH_2CH_2O)_nH$ [n = 35]

[Ao-4] $HO(CH_2CH_2O)_nH$ [n = 135]

[Ao-5] $HO(CH_2CH_2O)_nH$ [n = 225]

[Ao-6] $HO(CH_2CH_2O)_nH$ [n = 450]

[Ao-7] $n\text{-}C_4H_9O(CH_2CH_2O)_lH$ [l = 20]

[Ao-8] $n\text{-}C_8H_{17}O(CH_2CH_2O)_lH$ [l = 30]

[Ao-9] $n\text{-}C_{12}H_{25}O(CH_2CH_2O)_lH$ [l = 30]

[Ao-10] 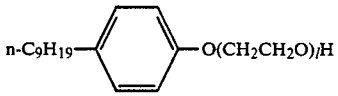 [l = 30]

[Ao-11] $n\text{-}C_{12}H_{25}S(CH_2CH_2O)H$ [l = 30]

[Ao-12] $C_4H_9S(CH_2CH_2O)_nCOCH_2CH_2COOH$ [n = 50]

[Ao-13] $HO(CH_2CH_2O)_l(CH_2)_m(CH_2CH_2O)_nCOCH_2CH_2COOH$ [l + n = 70, m = 5]

[Ao-14] $HO(CH_2CH_2O)_l(CH(CH_3)CH_2O)_m(CH_2CH_2O)_nH$ [l + n = 15, m = 17]

[Ao-15] $HO(CH_2CH_2O)_l(CH(CH_3)CH_2O)_m(CH_2CH_2O)_nH$ [l + n = 30, m = 35]

[Ao-16] $HO(CH_2CH_2O)_l(CH(C_2H_5)CH_2O)_m(CH_2CH_2O)_nH$ [l + n = 15, m = 15]

[Ao-17] $HO(CH_2CH_2O)_l(CH(C_2H_5)CH_2O)_m(CH_2CH_2O)_nH$ [l + n = 30, m = 15]

[Ao-18] $HO(CH_2CH_2O)_l(CH_2CH_2CH_2CH_2O)_m(CH_2CH_2O)_nH$ [l + n = 23, m = 21]

[Ao-19] $HO(CH_2CH_2O)_l(CH_2CH_2CH_2CH_2O)_m(CH_2CH_2O)_nH$ [l + n = 38, m = 15]

[Ao-20] $HO(CH_2CH_2O)_l(CH(CH_2OCH_3)CH_2O)_m(CH_2CH_2O)_nH$ [l + n = 15, m = 15]

[Ao-21] $HO(CH_2CH_2O)_l(CH(CH_2OCH_3)CH_2O)_m(CH_2CH_2O)_nH$ [l + n = 30, m = 15]

-continued

Example Compound

[Ao-22] $n\text{-}C_{12}H_{25}O(CH(CH_2OCH_3)CH_2O)_l(CH_2CH_2O)_nH$ [l = 7, m = 30]

[Ao-23] $n\text{-}C_{12}H_{25}S(CH(CH_3)CH_2O)_l(CH_2CH_2O)_mH$ [l = 7, m = 30]

[Ao-24] $HOOCCH_2CH_2C(=O)O(CH_2CH_2O)_l(CH_2CH_2O)_m(CH_2CH_2O)_nC(=O)CH_2CH_2COOH$ [l + n = 15, m = 15]

[Ao-25] $HOOCCH_2CH_2C(=O)O(CH_2CH_2O)_l(CH(CH_3)CH_2O)_m(CH_2CH_2O)_nC(=O)CH_2CH_2COOH$ [l + n = 15, m = 20]

[Ao-26] $C_{12}H_{25}N(CH_2CH_2O)_lH(CH_2CH_2O)_nH$ [l + n = 30]

[Ao-27] $C_{17}H_{33}C(=O)O(CH_2CH_2O)_{40}H$

[Ao-28] 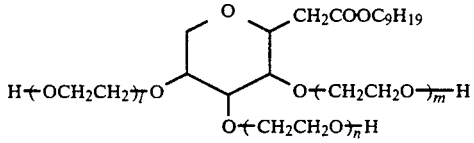

l + m + n = 20

[Ao-29] $C_{17}H_{35}CON(CH_2CH_2O)_lH(CH_2CH_2O)_mH$ l + m = 12

Epoxy compounds are preferable as the hardener to be employed in the water-insoluble conductive layer. An epoxy compound containing a hydroxy group or an ether linkage is especially preferable. Examples of suitable epoxy compounds are given below:

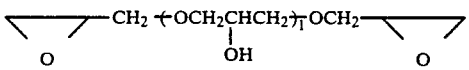

E-1

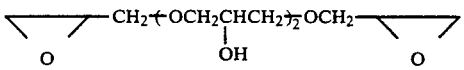

E-2

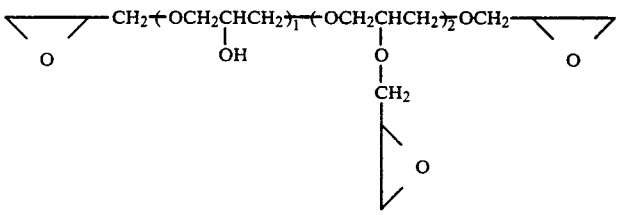

E-3

-continued

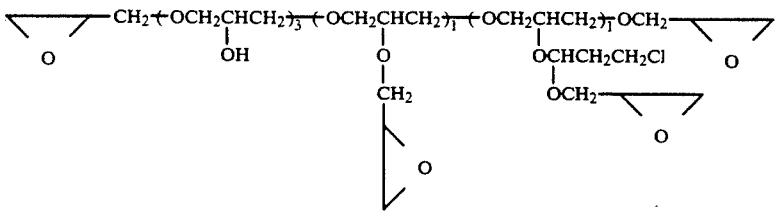

E-4

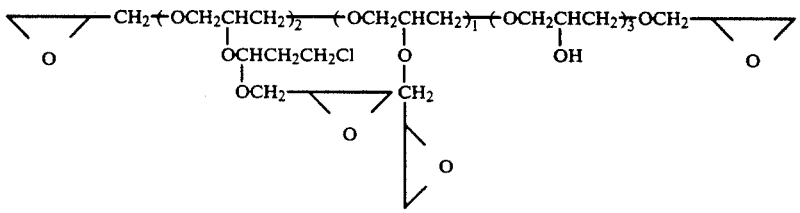

E-5

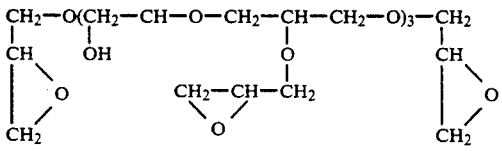

E-6

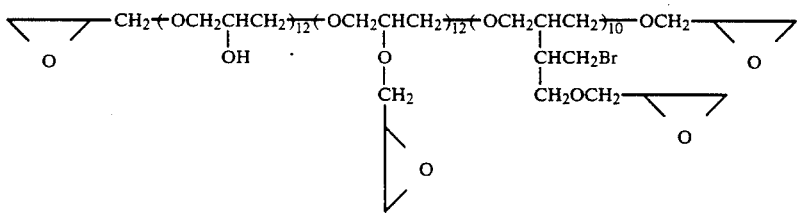

E-7

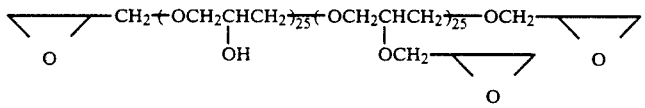

E-8

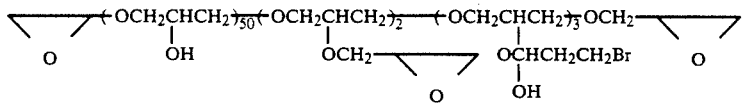

E-9

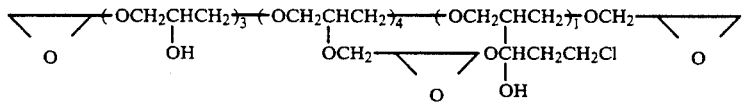

E-10

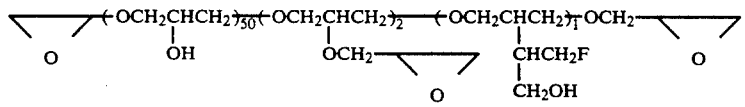

E-11

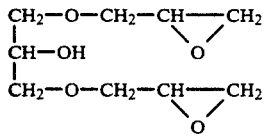

E-12

The compound represented by E may be added in the form of a solution obtained by dissolving it in an organic solvent such as water, alcohol and acetone, or in the form of a dispersion obtained by dispersing it in the presence of a surfactant such as dodecylbenzene sulfonate and nonylphenoxyalkylene oxide. The amount of the epoxy compound is preferably 1 to 1,000 mg per square meter of the light-sensitive material.

Next, preparation of the water-insoluble conductive layer consisting of a metal oxide will be explained.

Crystalline metal oxide particles are preferable as the metal oxide. In particular, a metal oxide containing an oxygen deficiency or a metal oxide containing a small amount of atoms of an element different from the metal in this oxide which constitute a donor for this metal oxide are generally useful due to its high conductivity. The latter type of metal oxide is especially preferable since it has an anti-fogging effect on silver halide emulsions.

Examples of suitable metal oxides include $ZnO_2$, $TiO_2$, $SnO_2$, $Al_2O3$, $In_2O_3$, $SiO_2$, MgO, BaO, $MoO_3$, $V_2O_5$ and mixtures thereof. Of them, $ZnO_2$, $TiO_2$ and $SnO_2$ are preferable. For forming a metal oxide containing atoms of a different kind of element, it is advisable to use Sb for $SnO_2$ and Nb or Ta for $TiO_2$. The amount of such foreign atoms is preferably 0.01 to 30 mol %, more preferably 0.1 to 10 mol %.

The metal oxide particles to be employed in the invention have electrical conductivity, and have a volume resistivity of $10^7\Omega$ or less, preferably $10^5\Omega$ or less. Such metal oxide particles are described in Japanese Patent Open to Public Inspection (hereinafter abbreviated as Japanese Patent O.P.I. Publication) Nos. 143431/1981, 120519/1981 and 62647/1983.

The metal oxide particles are employed after being dispersed or dissolved in a binder. Any type of binder is usable as long as it has a film-forming capability. Examples of suitable binders include protein such as gelatin and casein; cellulose compounds such as carboxymethyl cellulose, hydroxyethyl cellulose, acetyl cellulose, diacetyl cellulose and triacetyl cellulose; sugars such as dextran, agar, sodium alginate and starch derivatives; and synthetic polymers such as polyvinyl alcohol, polyvinyl acetate, polyacrylateester, polymethacrylateester, polystyrene, polyacrylamide, poly-N-vinylpyrrolidone, polyester, polyvinyl chloride and polyacrylic acid.

Of them, gelatin (e.g. lime-treated gelatin, acid-treated gelatin, enzyme-decomposed gelatin, phthalated gelatin, acetylated gelatin), acetyl cellulose, diacetyl cellulose, triacetyl cellulose, polyvinyl alcohol, vinyl polyacetate, butyl polyacrylate, polyacrylamide and dextran are preferable.

To lower the resistance of the conductive layer, it is preferred that the metal oxide particles occupy a larger volume of the conductive layer. However, at least 5 vol % of a binder must be contained in the conductive layer to make the layer tardy. In view of the above, the volume proportion of the metal particles is preferably 5 to 95%.

To obtain a satisfactory anti-static effect, the amount of the metal oxide is preferably 0.05 to 10 g, more preferably 0.01 to 5 g, per square meter of the light-sensitive material.

In the invention, the conductive layer and the emulsion layer may be provided on the same side of a support. But, good results can be obtained when the conductive layer is formed on the side of a support where no emulsion layer is provided.

The conductive layer is provided by applying a coating liquid for this layer onto a transparent support.

As the transparent support, any of conventional photographic supports can be used. Especially preferable is a film of polyethylene terephthalate or cellulose triacetate which can transmit 90% or more of visible rays.

These transparent supports can be prepared by known methods. If need arises, these supports may be colored with a small amount of a dye. In this case, the amount of the dye must be small enough not to hinder the transmission of light.

An undercoating layer containing a latex polymer may be provided on the support that has been subjected to corona discharge treatment. Energy generated by such corona discharge is preferably 1 mW to 1 $KW/m^2/min$. In the invention, it is preferable to subject the undercoating layer to corona discharge treatment before provision of the water-insoluble conductive layer thereon.

On the water-insoluble conductive layer, at least one silver halide light-sensitive emulsion layer is provided.

In the invention, it is preferable to add a hydrazine compound to the silver halide emulsion layer. As the hydrazine compound, compounds represented by the following Formula H are usable.

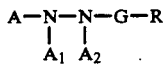

Formula H wherein A represents aryl or a heterocyclic group containing at least one sulfur atom or oxygen atom; G represents

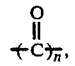

sulfonyl, sulfonyldioxy,

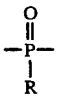

or imino; n represents an integer of 1 or 2; $A_1$ and $A_2$ each represent hydrogen, substituted or unsubstituted sulfonyl or substituted or unsubstituted, acyl, provided that at least one of $A_1$ and $A_2$ is hydrogen; and R represents hydrogen, alkyl, aryl, alkoxy, aryloxy, amino, carbamoyl, acyloxy or —O—$R_3$—where $R_3$ represents alkinyl or a saturated heterocyclic group.

The hydrazine compound to be employed in the invention is still preferably represented by either of the following formulae:

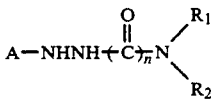

Formula A

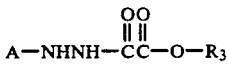

Formula B wherein A represents aryl (e.g. phenyl, napthyl) or a heterocyclic group containing at least one sulfur atom or oxygen atom (e.g. thiophene, furan, benzophene, pyran); $R_1$ and $R_2$ each represent hydrogen, alkyl (e.g. methyl, ethyl, methoxyethyl, cyanoethyl, hydroxyethyl, benzyl, trifluoroethyl), alkenyl (e.g. aryl, butenyl, pentenyl, pentadienyl), alkinyl (e.g. propargyl, butynyl, pentynyl), aryl (e.g. phenyl, naphthyl, cyanophenyl, methoxyphenyl), a heterocyclic group (e.g. unsaturated heterocyclic groups such as pyridine, thiophene and furan, and saturated heterocyclic groups such as tetrahydrofuran and sulforan), hydroxy, alkoxy(e.g. methoxy, ethoxy, benzyloxy, cyanomethoxy), alkenyloxy(e.g. aryloxy, butenyloxy), alkinyloxy (e.g. propargyloxy, butynyloxy), aryloxy (e.g. phenoxy, naphthyloxy) and a heterocyclic oxy(e.g. pyridyloxy, pyrimidyl oxy); $R_3$ represents alkinyl or a saturated heterocyclic group; and n represents an integer of 1 or 2. When n is 1, $R_1$, $R_2$ and a nitrogen atom may combine to form a ring (e.g. piperidine, piperazine, morphorine). When n is 2, at least one of $R_1$ and $R_2$ is alkenyl, alkinyl, a saturated heterocyclic group, hydroxy, alkoxy, alkenyloxy, alkinyloxy, aryloxy or heterocyclic oxy. Examples of the alkinyl group and the saturated heterocyclic group represented by $R_3$ include those mentioned above.

The aryl group and the heterocyclic group represented by A each may contain a substituent. Examples of suitable substituents include halogen, alkyl, aryl, alkoxy, aryloxy, acyloxy, alkylthio, arylthio, sulfonyl, alkoxycarbonyl, aryloxycarbonyl, carbamoyl, sulfamoyl, acyl, amino, alkylamino, arylamino, acylamino, sulfoneamide, arylaminothiocarbonylamino, hydroxy, carboxy, sulfo, nitro and cyano. Of them, sulfonamide is preferable.

It is preferred that A contain at least one anti-diffusion group or silver halide absorption promoter group. As the anti-diffusion group, a ballast group which is normally contained in photographic additives such as couplers is preferable. A ballast group is a group with 8 or more carbon atoms, which exerts only a slight influence on photographic properties. Examples of such ballast group include alkyl, alkoxy, phenyl, alkylphenyl, phenoxy and alkylphenoxy.

Examples of usable silver halide adsorption promoter groups include thiourea, thiourethane, heterocyclic thioamide, heterocyclic mercapto and triazole, which are described in U.S. Pat. No. 4,385,108.

In the Formula A or B, H of —NHNH—, i.e., the hydrogen atom of hydrazine, may be replaced by sulfonyl(e.g. methanesulfonyl, toluenesulfonyl), acyl(e.g. acetyl trifluoroacetyl, ethoxycarbonyl) or oxalyl(e.g.ethoxalyl, pyruvoyl) The compounds represented by the Formula A or B include such compounds.

In the present invention, the compounds represented by the Formula B and the compounds represented by the Formula A where n is 2 are preferable. The compounds represented by the Formula A where n is 2, $R_1$ and $R_2$ are each hydrogen, alkyl, alkenyl, alkinyl, aryl, a saturated or unsaturated heterocyclic group, hydroxy or alkoxy, and at least one of $R_1$ and $R_2$ is alkenyl, alkinyl, a saturated heterocyclic group, hydroxy or alkoxy are still preferable.

Representative examples of the compounds represented by the Formula A or B are given below, which should not be construed as limiting the scope of the invention.

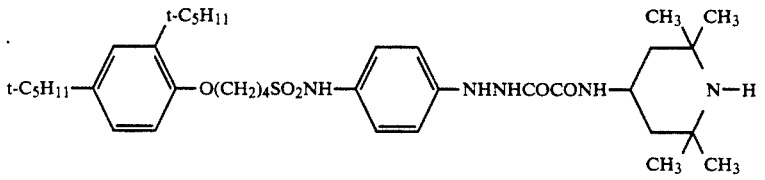

H-1

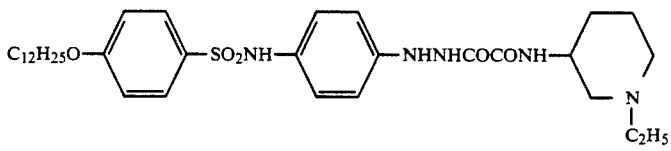

H-2

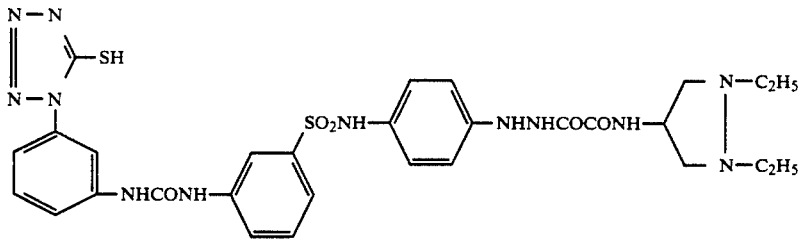

H-3

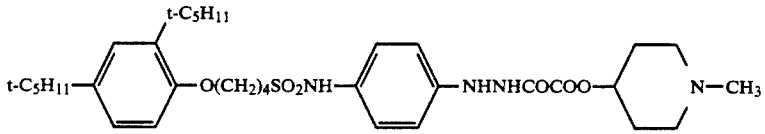

H-4

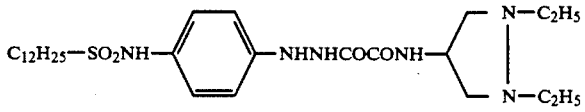

H-5

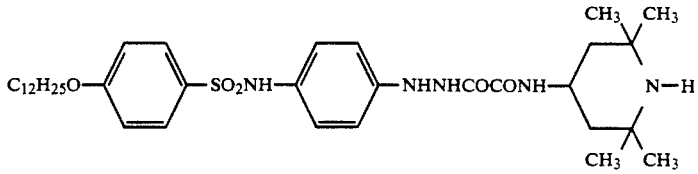

H-6

-continued

H-7

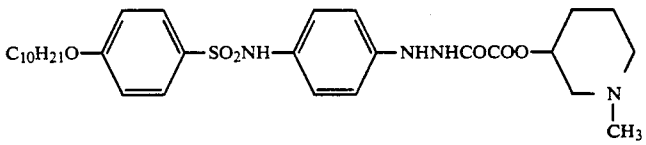

H-8

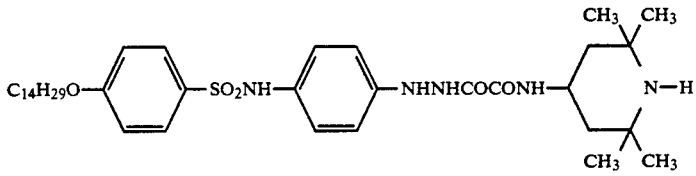

H-9

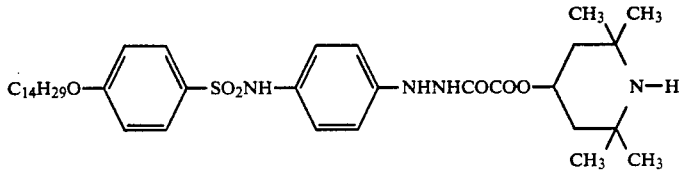

H-10

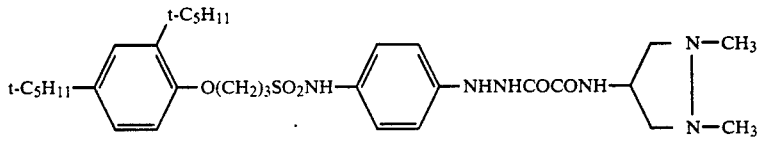

H-11

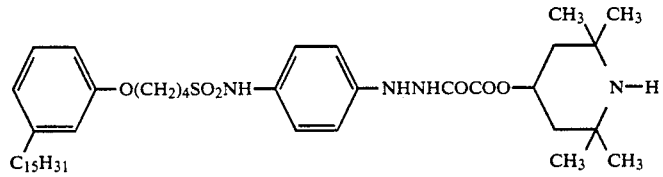

H-12

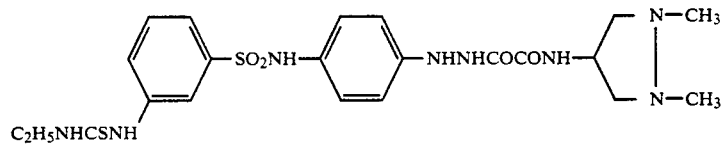

H-13

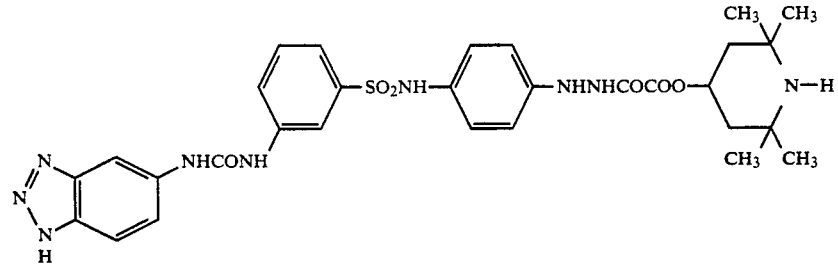

Hydrazine compounds (Compound Nos. 1 to 177) described in Japanese Patent O.P.I. Publication No. 234203/1990, pages 12 to 48, are also usable in the invention.

A hydrazine compound to be employed in the invention can be prepared by the method described in Japanese Patent O.P.I. Publication No. 234203/1990, pages 49 to 67.

In the invention, the hydrazine compound is added to the silver halide emulsion layer and/or a non-light-sensitive layer provided on the emulsion layer side of the support. It is preferred that the hydrazine compound be added to the silver halide emulsion layer and/or a layer adjacent to the emulsion layer. The amount of the hydrazine compound is preferably $1\times10^{-6}$ to $1\times10^{-1}$ mol, still preferably $5\times10^{-4}$ to $1\times10^{-2}$ mol, per mol silver.

Together with the hydrazine compound, at least one of the nucleus formation promoter compounds described in Japanese Patent O.P.I. Publication No. 234203/1990, page 68, line 1 to page 144, line 12, is recommended to be added to the silver halide emulsion layer and/or a non-light-sensitive layer which is provided on the emulsion layer side of the support. Representative examples of usable nucleus formation promoter compounds are given below.

When the hydrazine compound is added as a contrast improver, it is preferred that at least one of the nucleus formation promoter compounds described in Japanese Patent O.P.I. Publication No. 234203/1990, page 68, line 1 to page 144, line 12, be added to a silver halide emulsion layer and/or a non-light-sensitive layer provided on the emulsion layer side of the support.

Representative examples of the nucleus formation promoter compounds are given below:

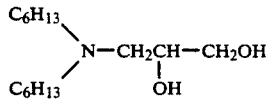

N-1

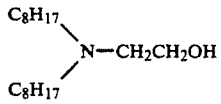

N-2

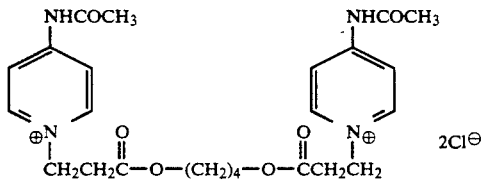

N-3

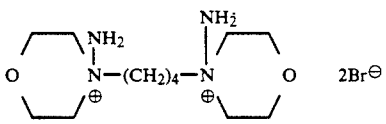

N-4

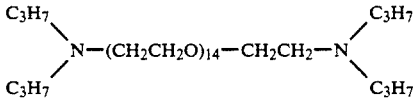

N-5

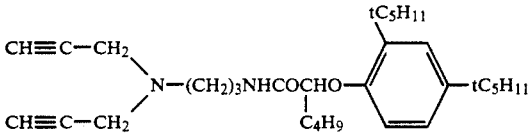

N-6

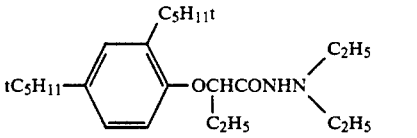

N-7

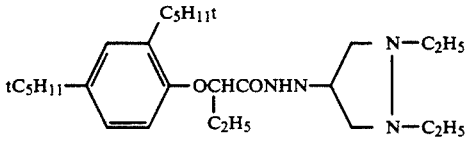

N-8

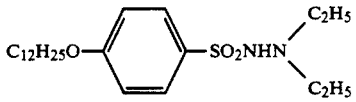

N-9

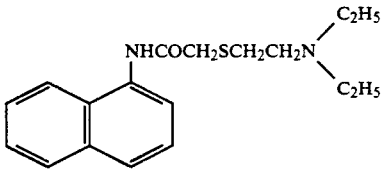

N-10

-continued

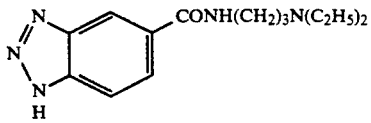

N-11

Other usable nucleus formation promoter compounds include Compound Nos. I-1 to 26 (pages 69 to 72), II-1 to 29(pages 73 to 78), III-1 to 25 (pages 80 to 83), IV-1 to 41(pages 84 to 90), V-I-1 to 27 (pages 92 to 96), V-II-1 to 30(pages 98 to 103), V-III-1 to 35 (pages 105 to 111), VI-I-1 to 44 (pages 113 to 121), VI-II-1 to 68 (pages 123 to 135) and VI-III-1 to 35 (pages 137 to 143) described in Japanese Patent O.P.I. Publication No. 234203/1990.

It is preferred that the light-sensitive material of the invention contain a compound represented by the following Formula T.

Formula T

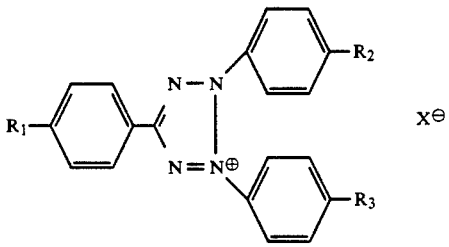

wherein $R_1$, $R_2$ and $R_3$ each represent hydrogen or a substituent, and $X^{\ominus}$ represents an anion.

Preferred examples of the substituents represented by $R_1$, $R_2$ or $R_3$ include alkyl such as methyl, ethyl, cyclopropyl, propyl, isopropyl, cyclobutyl, butyl, isobutyl, pentyl and cyclohexyl; amino; acylamino such as acetylamino; hydroxyl; alkoxy such as methoxy, ethoxy, propoxy, buthoxy and pentoxy; acyloxy such as acetyloxy; halogen such as fluorine, chlorine and bromine; carbamoyl; acylthio such as acetylthio; alkoxycarbonyl such as ethoxycarbonyl; carboxyl; acyl such as acetyl; cyano; nitro; mercapto; sulfoxy; and aminosulfoxy.

Examples of the anions represented by $X^{\ominus}$ include halogen ions such as chloride ions, bromide ions and iodide ions; radicals of inorganic acids such as nitric acid, sulfuric acid and perchloric acid, radicals of organic acids such as sulfonic acid and carboxylic acid and anionic activators. Specific examples include lower alkylbenzenesulfonic acid anions such as p-toluenesulfonic acid anions, higher alkylbenzenesulfonic acid anions such as p-dodecylbenzenesulfonic acid anions, higher alkylsulfate anions such as laurylsulfate anions, boric acid-based anions such as tetraphenylboron, dialkylsulfosuccinate anions such as di-2-ethylhexylsulfosuccinate anions, polyether alcohol sulfate anions such as cethylpolyethenoxysulfate anions, higher fatty acid anions such as stearic acid anions and polymers with acid radicals such as polyacrylic acid anions.

Representative examples of the compound represented by T are given below.

T-1
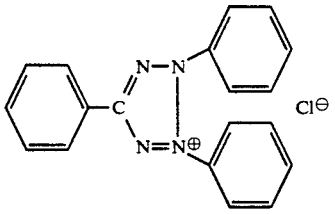
T-2
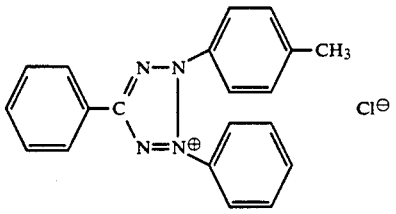
T-3
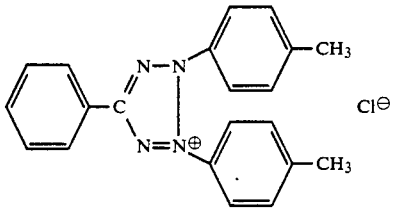
T-4
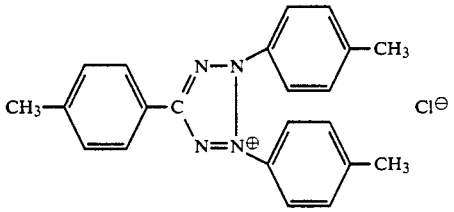
T-5
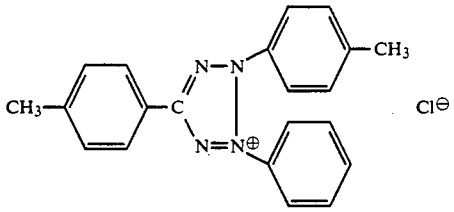
T-6
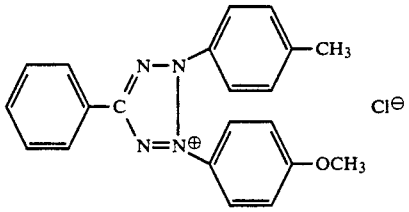
T-7
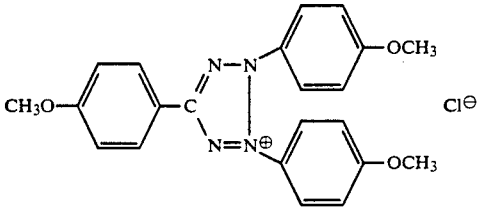
-continued
T-8
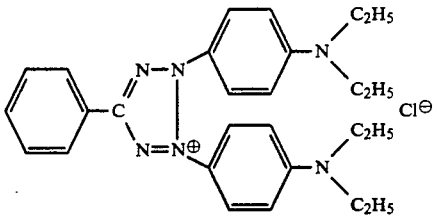
T-9
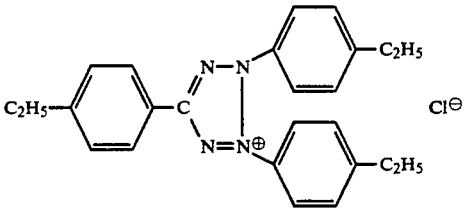
T-10
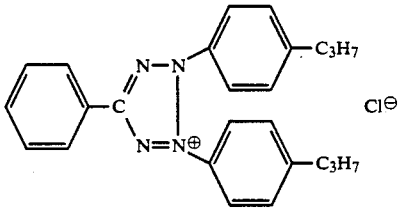
T-11
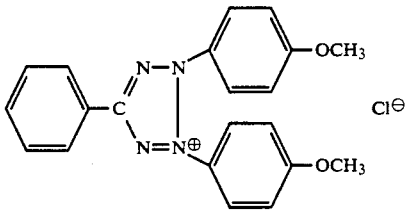
T-12
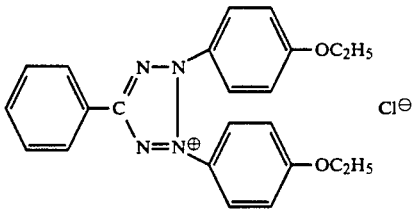
T-13
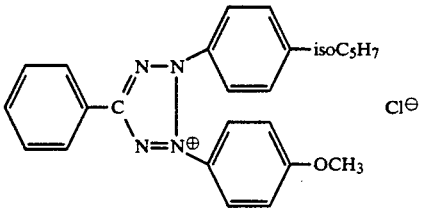
T-14
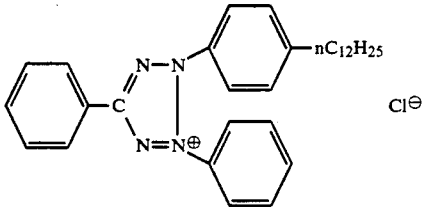

-continued

T-15

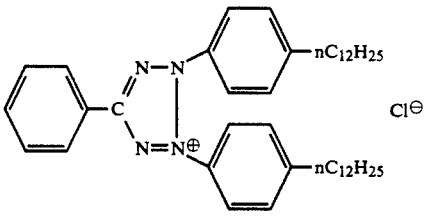

T-16

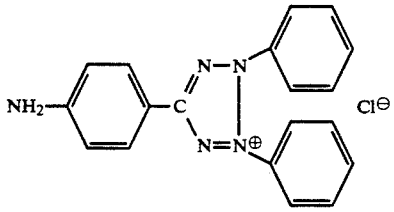

T-17

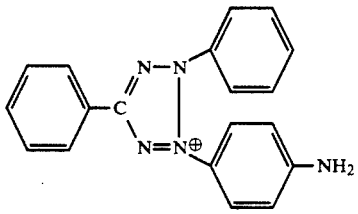

T-18

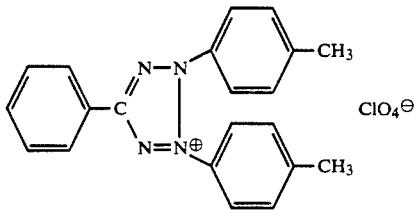

The tetrazolium compounds represented by the Formula T can be synthesized readily by the method described in Chemical Reviews Vol. 55, pages 335 to 483.

In the invention, the silver halide emulsion layer is spectrally sensitized. "Spectral sensitization" as referred to herein means sensitization with a sensitizing dye. Usable sensitizing dyes include cyanine dyes, merocyanine dyes, composite cyanine dyes, composite merocyaninedyes, holopolar cyanine dyes, hemicyanine dyes, styryl dyes and hemioxanol dyes. Of them, cyanine dyes, merocyanine dyes and composite merocyanine dyes are especially effective. These dyes may have a basic heterocyclic nucleus which is normally contained in a cyanine dye. Examples include a pyrroline nucleus; an oxazoline nucleus; a thiazoline nucleus; a selenazole nucleus; an imidazole nucleus; a tetrazole nucleus; a pyridine nucleus; a nucleus formed by the linkage of an alicyclic hydrocarbon ring to either of the above nuclei; and a nucleus formed by the linkage of an aromatic hydrocarbon ring to either of the above nuclei (e.g. an indolenine nucleus, a benzindolenine nucleus, an indole nucleus, a benzoxazole nucleus, a napthoxazole nucleus, a benzothiazole nucleus, a naphthothiazole nucleus, a benzoselenazole nucleus, a benzimidazole nucleus, a quinoline nucleus). These nuclei each may be substituted on the carbon atom.

Merocyanine dyes or composite merocyanine dyes each may have, as a nucleus with a ketomethylene structure, a 5-to 6-membered heterocyclic nucleus such as a pyrazoline-5-one nucleus, a thiohydantoine nucleus, 2-thiooxazolysine-2, 4-dione nucleus, a thiazolydine-2, 4-dione nucleus, a rhodanine nucleus and a thiobarbituric acid nucleus.

Representative examples of usable sensitizing dyes are described in Research Disclosure No. 17643(December 1978), page 23 and U.S. Pat. Nos. 4,425,425 and 4,425,426.

In the invention, it is preferable to employ an ortho sensitizing dye which has a maximum absorption at 450 to 580 nm; specifically those represented by the following Formula I or IV.

Formula I

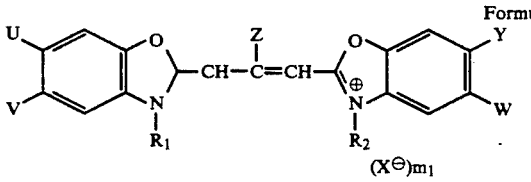

wherein $R_1$ and $R_2$ each represent substituted or unsubstituted alkyl, provided that at least one of them is sulfoalkyl or carboxyalkyl; Z represents alkyl or aralkyl; U, V, W and Y each represent hydrogen, halogen, substituted or unsubstituted alkyl, substituted or unsubstituted alkoxy, substituted or unsubstituted alkoxycarbonyl, carboxyl or hydroxyl; X represents an acid anion; and m represents 1 or 2, provided that m is 1 when an intramolecular salt is formed.

Examples of suitable substituents for $R_1$ and $R_2$ include hydroxyl, sulfo, sulfonate, carboxyl and its salt, carboxylate, halogen (e.g. fluorine, chlorine), substituted or unsubstituted alkoxy with 1 to 4 carbon atoms-(alkoxy may further be substituted with sulfo or hydroxyl), alkoxycarbonyl with 2 to 5 carbon atoms, alkylsulfonyl with 1 to 4 carbon atoms, sulfamoyl, substituted or unsubstituted carbamoyl (including carbamoyl substituted with alkyl with 1 to 4 carbon atoms), substituted phenyl(substituents sulfo, carboxyl, hydroxyl, etc.) and vinyl.

Examples of the unsubstituted alkyl include methyl, ethyl, propyl and butyl. Examples of the substituted alkyl include hydroxyalkyl such as 2-hydroxyethyl and 3-hydroxypropyl; 2-sulfoethyl, 3-sulfopropyl, 3-sulfobutyl, 4-sulfobutyl, 2-hydroxy-3-sulfopropyl and 2-chloro-3-sulfopropyl; carboxyalkyl such as carboxymethyl, carboxyethyl and carboxypropyl; 2,2,2-trifluoroethyl; 2-(3-sulfopropyloxy)ethyl; 2-(2-hydroxyethoxy)ethyl; ethoxycarbonylethyl; methylsulfonylethyl; sulfamoylalkyl such as 2-sulfamoylethyl, 2-carbomoylethyl and 2-N, N-dimethylcarbamoylethyl; phenethyl; p-carboxyphenethyl; sulfoaralkyl such as p-sulfophenethyl; p-hydroxyphenethyl; and phenoxyethyl.

As for the atoms and groups represented by U, V, W or Y, examples of the halogen atom include fluorine, chlorine and bromine; those of the alkyl group include methyl, ethyl, propyl and butyl; those of the alkoxy group include methoxy, ethoxy, propoxy and buthoxy; those of the alkoxycarbonyl include methoxycarbonyl and ethoxycarbonyl. Each of these groups maybe substituted with halogen, sulfo, hydroxy or carboxy.

Examples of the alkyl group represented by Z include methyl, ethyl and propyl. The aralkyl group represented by Z may be, for example, benzyl.

Examples of the acid anion represented by $X^{\ominus}$ chloride, bromide, iodide, thiocyanate, sulfonate, methylsulfonate, ethylsulfonate, perchlorate and p-toluenesulfonate.

Representative examples of the compounds represented by the Formula I are given in Table 1.

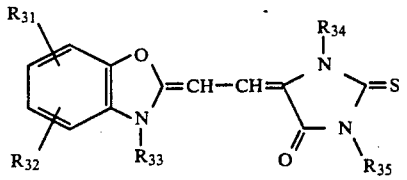

Formula IV

TABLE 1

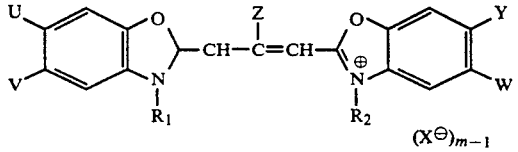

| No. | V | W | U | Y | $R_1$ | $R_2$ | Z |
|---|---|---|---|---|---|---|---|
| [I]-1 | Cl | Cl | H | H | $(CH_2)_3SO_3Na$ | $(CH_2)_3SO_3^{\ominus}$ | $C_2H_5$ |
| [I]-2 | Cl | Cl | H | H | $(CH_2)_4SO_3Na$ | $(CH_2)_3SO_3^{\ominus}$ | $C_2H_5$ |
| [I]-3 | Cl | Cl | $CH_3$ | H | $(CH_2)_3SO_3Na$ | $(CH_2)_3SO_3^{\ominus}$ | $C_2H_5$ |
| [I]-4 | Cl | Cl | $CH_3$ | $CH_3$ | $(CH_2)_3SO_3Na$ | $(CH_2)_3SO_3^{\ominus}$ | $C_2H_5$ |
| [I]-5 | Cl | 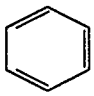 | H | H | $(CH_2)_3SO_3Na$ | $(CH_2)_3SO_3^{\ominus}$ | $C_2H_5$ |
| [I]-6 | Cl | 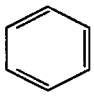 | $CH_3$ | H | $(CH_2)_3SO_3Na$ | $(CH_2)_3SO_3^{\ominus}$ | $C_2H_5$ |
| [I]-7 | Cl | 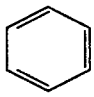 | $CH_3$ | $CH_3$ | $(CH_2)_3SO_3Na$ | $(CH_2)_4SO_3^{\ominus}$ | $C_2H_5$ |
| [I]-8 | $CH_3$ | 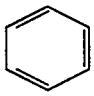 | $CH_3$ | $CH_3$ | $(CH_2)_3SO_3Na$ | $(CH_2)_3SO_3^{\ominus}$ | $C_2H_5$ |
| [I]-9 | $OCH_3$ | $OCH_3$ | H | H | $(CH_2)_3SO_3Na$ | $(CH_2)_3SO_3^{\ominus}$ | $C_2H_5$ |
| [I]-10 | $OCH_3$ | $OCH_3$ | H | H | $(CH_2)_3SO_3Na$ | $CH_2COO^{\ominus}$ | $C_2H_5$ |
| [I]-11 | 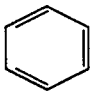 | 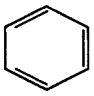 | H | H | $(CH_2)_3SO_3Na$ | $(CH_2)_3SO_3^{\ominus}$ | $C_2H_5$ |
| [I]-12 | $CF_3$ | $CF_3$ | H | H | $(CH_2)_3SO_3Na$ | $(CH_2)_3SO_3^{\ominus}$ | $C_2H_5$ |
| [I]-13 | $CF_3$ | 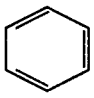 | H | H | $(CH_2)_4SO_3Na$ | $(CH_2)_3SO_3^{\ominus}$ | $C_2H_5$ |
| [I]-14 | 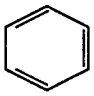 | $OCH_3$ | H | H | $(CH_2)_4SO_3Na$ | $(CH_2)_3SO_3^{\ominus}$ | $C_2H_5$ |
| [I]-15 | $OCH_3$ | $COCH_3$ | H | H | $(CH_2)_3SO_3Na$ | $(CH_2)_3SO_3^{\ominus}$ | $C_2H_5$ |
| [I]-16 | $OCH_3$ | 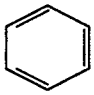 | H | H | $(CH_2)_3SO_3Na$ | $(CH_2)_3SO_3^{\ominus}$ | $C_2H_5$ |

In the formula, $R_{31}$ and $R_{32}$ each represent hydrogen-(e.g. chlorine, bromine), substituted or unsubstituted alkyl with 1 to 8 carbon atoms (e.g. methyl, ethyl, hydroxyethyl), substituted or unsubstituted alkoxy with 1 to 8 carbon atoms(e.g. methoxy, ethoxy), phenyl, naphthyl, sulfo or carboxy; $R_{33}$ represents substituted or unsubstituted alkyl(e.g. methyl, ethyl, sulfoethyl, sulfopropyl, sulfoamidoethyl, sulfobutyl) or substituted or unsubstituted alkenyl (e.g. allyl); $R_{34}$ represents substituted or unsubstituted alkyl with 1 to 12 carbon atoms; and $R_{35}$ represents halogen (e.g. chlorine, bromine), lower alkyl(e.g. methyl, ethyl), hydroxy, hydroxyalkyl (e.g. hydroxyethyl), alkoxy (e.g. methoxy, ethoxy), sulfo, phenyl orpyridyl.

$R_{31}$ and $R_{32}$ may combine with each other to form a 6-membered ring, which may be substituted with halogen, lower alkyl, hydroxy, hydroxyalkyl, phenyl, alkoxy or carboxy. Examples of preferable substituents for R34 include hydroxy and ureid. The alkyl represented by R34 includes those having —O—, —OCO— or —NH— between the carbon atoms. The pheny and pyridyl represented by R35 may be substituted with carboxy.

IV-1

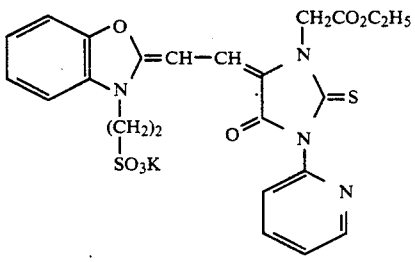

IV-2

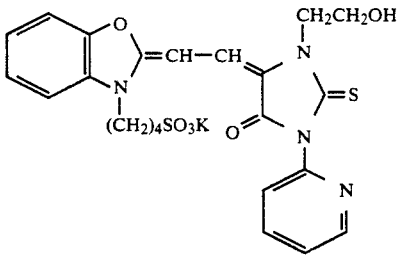

IV-3

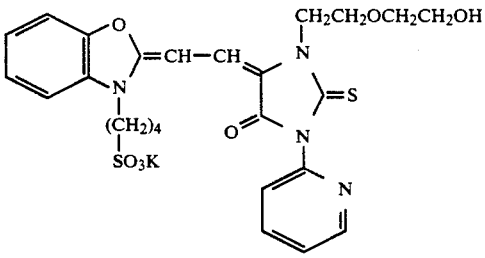

IV-4

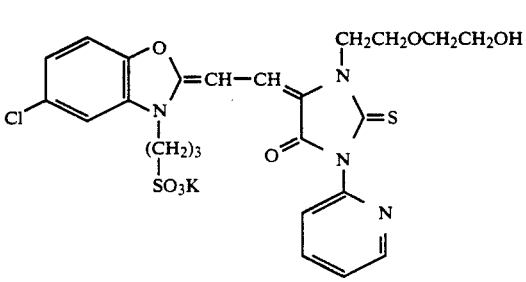

-continued

IV-5

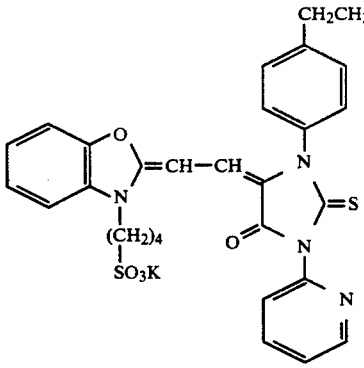

IV-6

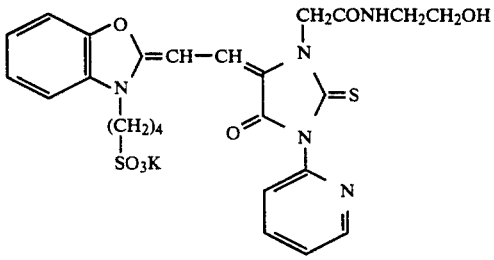

IV-7

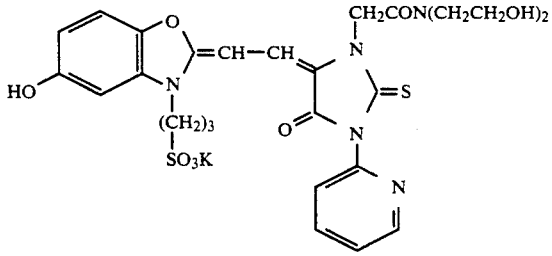

IV-8

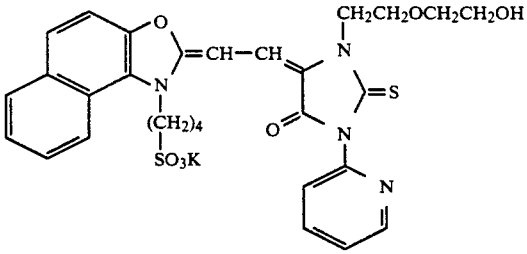

IV-9

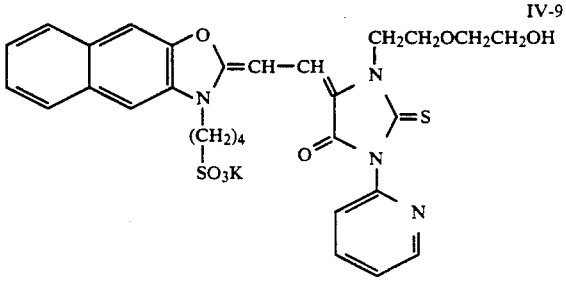

-continued

IV-10

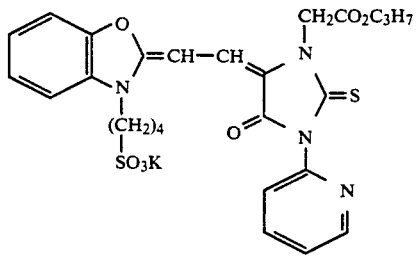

IV-11

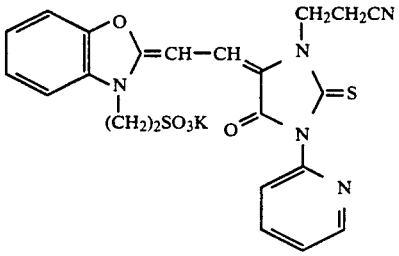

IV-12

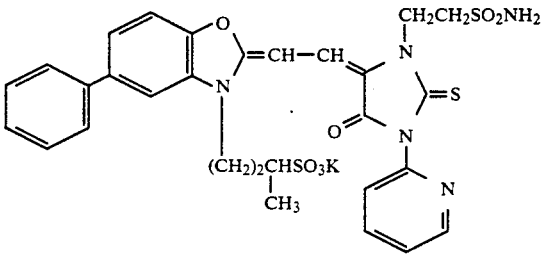

IV-13

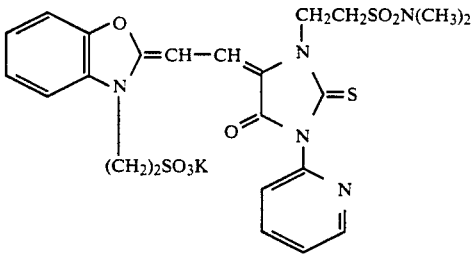

IV-14

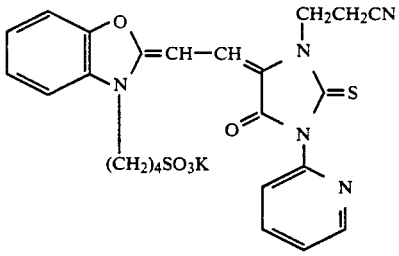

IV-15

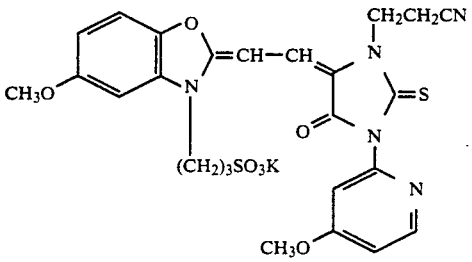

In the present invention, it is preferable to employ sensitizing dyes represented by the following Formula I, IV.

The sensitizing dyes represented by the Formula I, IV are known in the art, and can be synthesized readily by known methods. For instance, the method described in F. M. Homes, "The Cyanine Dyes and Related Compounds" (New York: Interscience Publishers, 1964) is applicable.

The addition and dispersion of the above sensitizing dyes in a silver halide emulsion can be performed by conventional methods. For instance, the method described in Japanese Patent Examined Publication No. 44895/1973 or Japanese Patent O.P.I. Publication No. 11419/1974 (dispersing a sensitizing dye in an emulsion in the presence of a surfactant), the method described in Japanese Patent O.P.I. Publication Nos. 16624/1978, 102732/1978, 102733/1978, U.S. Pat. Nos. 3,469,987 and 3,676,147 (preparing a dispersion of a sensitizing dye and a hydrophilic substrate, and adding the dispersion to an emulsion), or the method described in GDR Patent No. 143,324 (adding a sensitizing dye in the form of a solid solution) are usable. It is also possible to dissolve a merocyanine dye in a water-soluble solvent such as water, ethanol, methanol, acetone, propanol, fluorinated alcohol and pyridine or a mixture thereof, and add the resulting solution into an emulsion. The time for adding the sensitizing dye to an emulsion is not limitative, and it may be added at any time during the preparation of an emulsion. However, the best time for the addition is during or after chemical ripening. The amount of the sensitizing dye represented by the Formula I, II or III is such that an emulsion can be spectrally sensitized; e.g., $10^{-5}$ to $2\times10^{-2}$ mol, preferably $10^{-4}$ to $2\times10^{-3}$ mol, per mol silver halide.

A silver halide light-sensitive emulsion to be employed in the invention may comprise any of conventional silver halides, such as silver bromide, silver chloride, silver iodobromide, silver chlorobromide and silver chloroiodobromide. Silver halide grains can be prepared by any of the acid method, the neutral method and the ammonia method.

A silver halide grain may have a uniform halide composition, or may be of a core/shell structure in which the interior and the surface have different halogen compositions. A latent image may be formed either on the surface or the interior of a grain. Though the shape of a silver halide grain is not limitative, a cubic grain having a 100 face as the crystal face is preferable. Also usable are octahedral, dodecahedral and tetradecahedral grains, which can be prepared by the methods described in U.S. Pat. Nos. 4,183,756, 4,225,666, Japanese Patent O.P.I. Publication No. 26589/1980, Japanese Patent Examined Publication No. 42737/1980, and The Journal of Photographic Science, 21, 39 (1973). Grains with a twinning face are also usable.

Silver halide grains to be employed in the invention may be either uniform or differing from each other in shape. The size distribution of grains is also not limitative; grains may be either polydispersed or monodispersed. A mixture of two or more kinds of monodispersed or polydispersed emulsions or a combination of a monodispersed emulsion and a polydispersed emulsion is usable. It is also possible to employ two or more emulsions that have been separately prepared in combination.

A silver halide light-sensitive emulsion is normally subjected to chemical sensitization, but it is possible to use it in a primitive state. Chemical sensitization can be performed by the methods described in books written by Glafkides and Zelikman, or by the method described in H. Frieser, "Die Grundlagen der Photographischen Prozesse mit Silberhalogeniden" (Akademicche Verlagsgesellschaft, 1968). According to these methods, chemical sensitization is conducted by using a compound containing a sulfur that can react with a silver ion or activated gelatin (the sulfur sensitization method), or by using a reducing substance (the reduction sensitizing method), or by using gold and other noble metal compounds (the noble metal sensitization method). Combined use of two or more of these chemical sensitizers is permissible.

Two or more light-sensitive emulsions may be employed in combination.

After chemical sensitization, various stabilizers such as 4-hydroxy-6-methyl-1,3,3a,7-tetrazaindene, 5-mercapto-1-phenyltetrazole and 2-mercaptobenzothiazole may be added to an emulsion.

Solvents for silver halides such as thioether and crystal habit controlling agents such as mercapto-containing compounds and sensitizing dyes may be employed at need.

After the completion of grain growth, excessive soluble salts may or may not be removed from an emulsion. Such desalting can be performed by the method described in Research Disclosure No. 17643.

The silver halide light-sensitive material of the invention may further contain additives described in Research Disclosure Vol. 176, item 17643 (December 1978) and Vol 187, item 18716 (November 1979). See below.

| Additives | RD17643 | RD18716 |
|---|---|---|
| 1. Chemical sensitizer | p. 23 | p. 648, right column |
| 2. Sensitivity improver | | " |
| 3. Spectral sensitizer, supersensitizer | pp. 23–24 | p. 648, right column to p. 649, right column |
| 4. Brightener | p. 24 | |
| 5. Anti-foggant, stabilizer | p. 24–25 | p. 649, right column |
| 6. Light absorber, filter dye, UV absorber | p. 25–26 | p. 649, right column to p. 650, left column |
| 7. Anti-stain agent | p. 25, right column | p. 650, left column to p. 651, right column |
| 8. Dye image stabilizer | p. 25 | |
| 9. Hardener | p. 26 | p. 651, left column |
| 10. Binder | p. 26 | " |
| 11. Plasticizer, lubricant | p. 27 | p. 650, right column |
| 12. Coating aid, surfactant | p. 26–27 | " |
| 13. Anti-static agent | p. 27 | " |

In the invention, a light-sensitive emulsion layer and other layers may be provided either one side or both sides of a flexible support. As the support, usable are films of semi-synthesized or synthesized polymers such as cellulose nitrate, cellulose acetate, cellulose lactate, polystyrene, polyvinyl chloride, polyethylene terephthalate and polycarbonate; baryta paper; and paper coated with an α-olefin (e.g. polyethylene, polypropylene, ethylene/butene copolymers). The support may be colored with a dye or a pigment; for instance, it may be colored in black for the purpose of light-shielding. The surface of the support is normally subbed so that it can be brought into closer contact with an emulsion layer or other layers. Subbing is performed preferably by the methods described in Japanese Patent O.P.I. Publication Nos. 104913/1977, 18949/1984, 19940/1984 and 11941/1984.

Provision of an emulsion layer and other hydrophilic colloidal layers may be performed by known methods, such as the dip coating method, the roller coating method, the curtain coating method and the extrusion coating method.

The light-sensitive material of the invention, after exposure to light, may be processed by conventional methods.

EXAMPLES

The present invention will be described in more detail according to the following examples which should not be construed as limiting the scope of the invention.

EXAMPLE 1

Preparation of Support 1 with Conductive layer

A polyethylene terephthalate film was subjected to corona discharge treatment (energy: 10W/m$^2$ min), and then subbed with a styrene-containing hydrophobic latex. This film was again subjected to corona discharge treatment (energy: 10W/m$^2$ min). To an anti-static liquid with the following composition, an epoxy hardener E was added. After being adjusted to have a pH of 5.0 with sulfuric acid, the anti-static liquid was applied onto the support by means of an air knife coater. The amount of the anti-static liquid was 10 cc/m$^2$. The speed of application was 50 m/min. (Composition of Anti-static Liquid)

| | |
|---|---|
| Water-soluble conductive polymer A-3 | Amount shown in Table 2 or 3 |
| Hydrophobic polymer particles B-11 | 40 g/l |
| Ammonium sulfate | 0.5 g/l |
| Polyethylene oxide compound AO-4 (number average molecular weight 600) | 6 g/l |
| Hardener | |
| E-1 | 6 g/l |
| E-6 | 6 g/l |

The quantity of the above liquid was 1 l. The hardeners E-1 and E-6 were added during the application of this liquid.

The film was then dried at parallel flow drying conditions (dry air temperature: 90° C., overall heat transfer coefficient: 25 Kcal/m$^2$ hr° C.) for 30 seconds, followed by heat treatment at 140° C. for 90 seconds, whereby an anti-static layer was formed on the polyethylene terephthalate film support.

Preparation of Support 2 with Conductive Layer

A polyethylene terephthalate film was subjected to corona discharge treatment (energy: 10 W/m$^2$ min), and then subbed with a styrene-containing hydrophobic latex. This film was again subjected to corona discharge treatment(energy: 10 W/m$^2$ min). To an anti-static liquid with the following composition, an epoxy hardener E was added. After adjusting pH to 5.0 with sulfuric acid, the anti-static liquid was applied onto the support by means of an air knife coater. The amount of the anti-static liquid was 10 cc/m$^2$. The speed of application was 50 m/min.

| (Composition of Anti-static liquid) | |
|---|---|
| $SnO_2/Sb$ (8/2) (particle size: 0.3 μm) | Amount shown in Table 4 |
| Hydrophobic polymer particles B-11 | 40 g/l |
| Ammonium sulfate | 0.5 g/l |
| Polyethylene oxide compound AO-4 (number average molecular weight: 600) | 6 g/l |
| Hardener | |
| E-1 | 6 g/l |
| E-6 | 6 g/l |

The quantity of the above liquid was 1 l. The hardeners E-1 and E-6 were added during the application of this liquid. The film was then dried at parallel flow drying conditions(dry air temperature: 90° C., overall heat transfer coefficient: 25 K cal/m$^2$.hr.° C.) for 30 seconds, followed by heat treatment at 140° C. for 90 seconds, whereby an anti-static layer was formed on the polyethylene terephthalate film support.

Preparation of Support 3

A polyethylene terephthalate film was subbed with a primer described in Example 1 of Japanese Patent O.P.I. Publication No. 19941/1984.

Preparation of Silver Halide Light-Sensitive Material

Preparation of Emulsion A

A silver chlorobromide emulsion was prepared by using the following liquids A, B and C.

| | |
|---|---|
| Solution A | |
| Ossein gelatin | 17 g |
| Sodium salt of polyisopropylene-polyethyleneoxy disuccinate (10% ethanol aqueous solution) | 5 ml |
| Distilled water | 1280 ml |
| Solution B | |
| Silver nitrate | 170 g |
| Distilled water | 410 ml |
| Solution C | |
| Sodium chloride | 45.0 g |
| Potassium bromide | 27.4 g |
| Rhodium trichloride (trihydrate) | 28 μg |
| Sodium salt of polyisopropyleneoxy disuccinate (Aqueous 10% ethanol solution) | 3 ml |
| Ossein gelatin | 11 g |
| Distilled water | 407 ml |

Solution A was heated to 40° C., and sodium chloride was added so that EAg became 160 mV.

Using the stirrer described in Japanese Patent O.P.I. Publication Nos. 92523/1982 and 92524/1982, Solutions B and C were added to Solution A by the double-jet method for 80 minutes. During the addition, the flow rates of the solutions were gradually varied as shown in Table 1.

Five minutes after the addition, EAg was decreased to 120 mV from the initial value of 160 mV with an aqueous sodium chloride solution (3 ml/l), and maintained at this value for the remaining minutes using 3 mols/l of an aqueous sodium chloride solution.

TABLE 1

| Addition time (min) | Liquid B (ml/min) | Liquid C (ml/min) |
|---|---|---|
| 0 | 1.13 | 1.11 |
| 10 | 1.13 | 1.11 |
| 20 | 2.03 | 1.99 |
| 30 | 3.17 | 3.11 |
| 40 | 4.57 | 4.48 |

TABLE 1-continued

| Addition time (min) | Liquid B (ml/min) | Liquid C (ml/min) |
|---|---|---|
| 50 | 6.22 | 6.10 |
| 60 | 8.13 | 7.97 |
| 70 | 10.29 | 10.01 |
| 80 | 12.74 | 12.49 |

Measurement of EAg was performed using a pair of silver electrodes and a pair of double-junction type saturated Ag/AgCl comparison electrodes (the configuration of the double-junction type electrodes was the same as that disclosed in Japanese O.P.I. Publication No. 197534/1982).

The flow rates of Solutions B and C were varied by means of a roller tube pump.

During the addition, part of the emulsion was taken out, and examined by an electron microscope. The electron microscopic observation revealed there were no newly formed grains in the emulsion.

During the addition, pH of the reaction system was maintained at 3.0 with an aqueous 3% silver nitrate solution.

When the addition of Solutions B and C was completed, the emulsion was subjected to the OstwaldLs ripening for 10 minutes, followed by desalting and rinsing in the usual way. Thereafter, 600 ml of an aqueous solution of ossein gelatin (ossein gelatin content: 30 g) was added, and stirred at 55° C. for 30 minutes to allow the grains to be dispersed. The total quantity of the emulsion was adjusted to 750 ml. The so-formed emulsion was designated as Emulsion A.

Emulsion A was subjected to gold sulfur sensitization, followed by addition of potassium bromide in an amount of 500 mg per mol silver halide. Then, the following sensitizing dye (Sensitizing dye A) was added in an amount of 300 mg per mol silver halide, and the emulsion was allowed to stand for 10 minutes Then, 4-hydroxy-6-methyl-1,3,3a,7-tetrazaindene as a stabilizer and 100 mg of the following sensitizing dye (Sensitizing dye B) per mol silver halide were added to the emulsion.

Sensitizing dye A

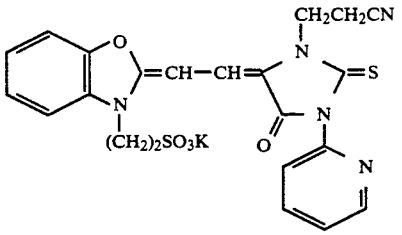

Sensitizing dye B

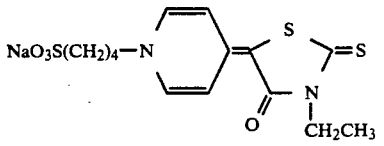

Then, a tetrazolium compound (Compound No. T-11) was added in an amount of 700 mg per mol silver halide. Further, 300 mg of sodium p-dodecylbenezenesulfonate, 2 g of a styrene-maleic acid copolymer, and a latex of a styrene-butylacrylate-acrylic acid copolymer (average particle size: 0.25 μm) was added in an amount shown in Table 2. The emulsion was then applied onto the Support 1 (Example 1) in such a manner that the silver content and the gelatin content became 4.0 g/m$^2$ and 2.00 g/m$^2$, respectively. The emulsion was applied on the side where no conductive layer was provided. Simultaneously with the provision of the emulsion layer, a protective layer containing 10 mg/m$^2$ of bis-(2-ethylhexyl)sulfosuccinate (spreader), the following compounds (Compounds C and D) and 20 mg/m$^2$ of glyoxazole was provided. The application was performed in such a manner that the gelatin content of the layer became 0.75 g/m$^2$.

| Compound C | |
|---|---|
| 1-Phenyl-3-pyrazolidone | 80 mg per mol silver |
| Compound D | |

-continued

| | |
|---|---|
| 5-Nitroindazole | 80 mg per mol silver |

On the reverse side of the support, a back coating layer and a protective layer for the back coating layer with the following compositions were provided.

(Composition of Back Coating Layer)

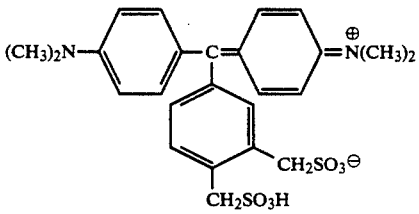

40 mg/m$^2$

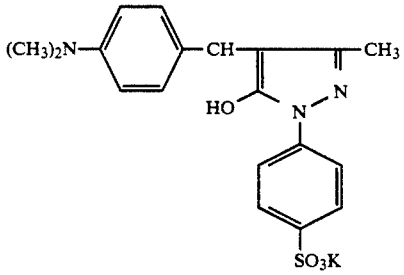

30 mg/m$^2$

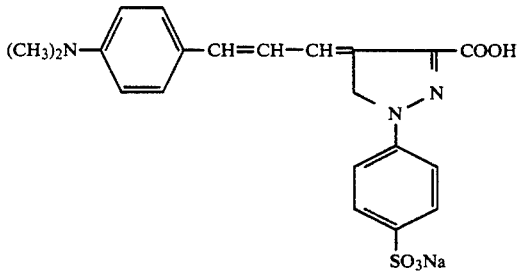

30 mg/m$^2$

| | |
|---|---|
| Gelatin | Amount shown in Table 2 |
| Surfactant: saponin | 0.1 g/m$^2$ |
| Hardener: glyoxazole | 0.01 g/m$^2$ |
| Sodium dodecylbenzenesulfonate | 0.01 g/m$^2$ |
| (Composition of Protective Layer for Back Coating Layer) | |
| Gelatin | Amount shown in Table 2 |
| Matting agent: polymethylmethacrylate with an average particle size of 3.0 to 5.0 μm | Amount shown in Table 2 |
| Surfactant S-2: | |
| $CH_2COOCH_2(C_2H_5)C_4H_9$ \| $CHCOOCH_2CH(C_2H_5)C_4H_9$ \| $SO_3Na$ | 10 mg/m$^2$ |
| Hardener: glyoxazole | 25 mg/m$^2$ |

Each of the so-obtained silver halide light-sensitive material samples was rolled up with its emulsion layer side in. Each roll was left at 35° C. and RH 50% for 5 days.

The so-obtained silver halide light-sensitive material samples were examined for curling, jamming and pinhole formation.

Examination on Curling

A specimen (10 mm×100 mm) was cout out from each roll of sample filme (508 mm×61 m). The speciment was left at 25° C. and 20%RH for 4 hours, and then hung down with its one short side being fixed so that its long side became vertical with respect to the floor. The distance between the other short side of the specimen and a line vertical to the floor was measured. When the distance is 0, it means the specimen did not curl. When the distance is 1 or longer, it means that the specimen curled in the direction of the emulsion layer or in the direction of the back coating layer. The results of the examination were shown in Table 2. As for the curling in the direction of the back coating layer, the distances are indicated with negative signs.

Examination on Jamming

A specimen with a width of 508 mm and a length of 30 cm was cut out from each roll of sample film (508 mm×61 mm). This specimen was placed in C880F, and exposed to light 100 times. Evaluation was made according to the following criterion:

o . . . No jamming x . . . Jamming occurred

The results are shown in Table 2.

Examination on pinhole formation

Each sample was subjected to moisture conditioning at 25° C. and RH20% for 2 hours. Then, a rubber roller was moved over the surface of each sample, allowing electrostatic charges to be generated thereon. Then, ashes from a cigar were sprinklled over the emulsion layer side. After brushing off the ashes lightly, each sample was exposed to light, using a Fine Zoom C-880F (manufactured by Dainippon Screen Co.) as a camera and a sheet of paper with a dot area of 10% as an original. Exposure was conducted in such a manner that a negative image with a dot area of 90% could be obtained. After processing, the emulsion layer side of each sample was visually observed with a loupe (magnification: ×10), and examined whether pinholes were formed or not. Evaluation was made according to the following criterion:

5: No pinholes.

4: Almost no pinholes.

3: A few pinholes, but not commercially problematic.

2: A large number of pinholes.

1: An extremely large number of pinholes.

The results obtained are summarized in Table 2.

Measurement of Specific Surface Resistance

Each sample was subjected to moisture conditioning at 25° C. and RH20% for 2 hours. Then, the specific surface resistance of the back coating side of each sample was measured by means of a Tetra ohmmeter (R-503, manufactured by Kawaguchi Electric Co.).

TABLE 2

| | Support No. | Conductive layer Aqueous conductive polymer (g/l) | BC side: BC layer Gelatin content ($g/m^2$) | BC side: BC protective layer Gelatin content ($g/m^2$) | BC side: BC protective layer Matting agent ($mg/m^2$) | Emulsion layer Latex ($g/m^2$) | Specific surface resistance (Ω) | Curing (mm) | Jamming | Pinhole | |
|---|---|---|---|---|---|---|---|---|---|---|---|
| 1 | 1 | 60 | 1.5 | 0.5 | 80 | 1.0 | $1 \times 10^{10}$ | 8 | x | 4 | Comparative |
| 2 | 1 | 60 | 2.0 | 0.5 | 80 | 1.0 | $1 \times 10^{10}$ | 5 | x | 5 | Comparative |
| 3 | 1 | 60 | 2.0 | 0.7 | 80 | 1.0 | $1 \times 10^{10}$ | 3 | x | 5 | Comparative |
| 4 | 1 | 60 | 2.0 | 1.0 | 80 | 1.0 | $1 \times 10^{10}$ | −3 | o | 5 | Invention |
| 5 | 1 | 60 | 2.2 | 0.5 | 80 | 1.0 | $1 \times 10^{10}$ | 3 | x | 5 | Comparative |
| 6 | 1 | 60 | 2.4 | 0.5 | 80 | 1.5 | $1 \times 10^{10}$ | −6 | o | 5 | Invention |
| 7 | 1 | 60 | 3.0 | 0.5 | 80 | 1.0 | $1 \times 10^{10}$ | −8 | o | 5 | Invention |
| 8 | 1 | 60 | 3.0 | 1.0 | 80 | 1.0 | $1 \times 10^{10}$ | −10 | o | 4 | Invention |
| 9 | 1 | 120 | 2.0 | 1.0 | 80 | 1.0 | $5 \times 10^{8}$ | −3 | x | 5 | Comparative |
| 10 | 1 | 60 | 2.0 | 1.0 | 40 | 1.0 | $1 \times 10^{10}$ | −5 | o | 5 | Invention |
| 11 | 1 | 60 | 2.0 | 1.0 | 40 | 1.5 | $1 \times 10^{10}$ | −5 | o | 5 | Invention |
| 12 | 3 | 60 | 2.0 | 1.0 | 80 | 1.0 | $2 \times 10^{12}$ | −3 | o | 1 | Comparative |

*The combined amount of gelatin in the emulsion layer side was 2.75 $g/m^2$.

The table shows that a number of pinholes were formed in the samples which had a specific surface resistance exceeding $1 \times 10^{12}\Omega$ on the back coating side. The samples with a specific surface resistance on the back coating side of smaller than $1 \times 10^{9}\Omega$ suffered serious jamming even though they curled in the direction of the back coating side. On the other hand, the samples curled in the direction of the emulsion layer side underwent jamming even though they had a specific surface resistance of $1 \times 10^{9}$ to $1 \times 10^{12}\Omega$ on the back coating side. The samples which had a specific surface resistance of $1 \times 10^{9}$ to $1 \times 10^{12}\Omega$, and at the same time, curled in the direction of the back coating side, could be free from the problems of pinhole formation and jamming. As stated above, to make a light-sensitive material curl in the direction of its back coating side, it is necessary to adjust the amounts of gelatin, a latex and a matting agent to suitable values.

EXAMPLE 2

Light-sensitive materials were prepared in substantially the same manner as in Example 1, except that the preparation of the emulsion was changed as mentioned below. The so-formed light-sensitive materials were evaluated by the same methods as employed in Example 1.

Preparation of Emulsion

An aqueous silver nitrate solution, and an aqueous solution of potassium bromide and potassium iodide were mixed by the double-jet method in the presence of ammonia while maintaining pAg to 7.9, whereby an emulsion comprising monodispersed cubic silver iodobromide grains with an average grain size of 0.2 μm (silver iodide content 1 mol %, silver bromide content: 99 mol %) was obtained. This emulsion was designated as Emulsion B.

On the other hand, an aqueous silver nitrate solution and an aqueous potassium bromide solution were mixed by the double-jet method in the presence of ammonia while keeping pAg to 7.9, whereby an emulsion comprising monodispersed cubic silver bromide grains with an average grain size of 0.35 μm was obtained. This emulsion was designated as Emulsion C. Emulsion B was subjected to sulfur sensitization with sodium thiosulfate. Each of Emulsions B and C was spectrally sensitized by adding a sodium salt of 5,5'-dichloro-3,3'-di(3-sulfopropyl)-9-ethyl-oxacarboxyami ne as a sensitizing dye. The amount per mol silver of the spectral sensitizer was $6\times10^{-4}$ mol for Emulsion B, and $4.5\times10^{-4}$ mol for Emulsion C. Together with the sensitizers, 0.4 mol per mol silver of potassium iodide was added to each emulsion. 4-Hydroxy-6-methyl-1,3,3a,7-tetrazaindene was also added as a stabilizer.

Emulsions B and C were then mixed in a mixing ratio (in terms of the weight of silver halides) of 6:4. To this mixture, Compound H-3 (a hydrazine compound of the invention) was added in an amount of 1,200 g per mol silver.

Further, alkylbenzenesulfonate as a surfactant and a vinylsulfone-based hardener were added. The pH of the mixed emulsion was adjusted to 5.8. The emulsion was then applied onto the support such that the amounts of silver and gelatin became 3.6 g/m² and 2 g/m², respectively.

The so-obtained light-sensitive materials were evaluated for curling, jamming and pinhole formation by the same methods as those employed in Example 1. Similar results to those obtained in Example 1 were obtained.

TABLE 4

| | Support No. | Conductive layer $SnO_2$/Sb (mg/m²) | BC side: BC layer Gelatin content (g/m²) | BC side: BC protective layer Gelatin content (g/m²) | BC side: BC protective layer Matting agent (mg/m²) | Emulsion layer Latex (g/m²) | Specific surface resistance (Ω) | Curing (mm) | Jamming | Pinhole | |
|---|---|---|---|---|---|---|---|---|---|---|---|
| 1 | 2 | 250 | 1.5 | 0.5 | 80 | 1.0 | $7\times10^{9}$ | 7 | x | 4 | Comparative |
| 2 | 2 | 250 | 2.0 | 0.5 | 80 | 1.0 | $7\times10^{9}$ | 4 | x | 5 | Comparative |
| 3 | 2 | 250 | 2.0 | 0.7 | 80 | 1.0 | $7\times10^{9}$ | 3 | x | 5 | Comparative |
| 4 | 2 | 250 | 2.0 | 1.0 | 80 | 1.0 | $7\times10^{9}$ | −4 | o | 5 | Invention |
| 5 | 2 | 250 | 2.2 | 0.5 | 80 | 1.0 | $7\times10^{9}$ | 3 | x | 5 | Comparative |
| 6 | 2 | 250 | 2.4 | 0.5 | 80 | 1.5 | $7\times10^{9}$ | −7 | o | 5 | Invention |
| 7 | 2 | 250 | 3.0 | 0.5 | 80 | 1.0 | $7\times10^{9}$ | −9 | o | 5 | Invention |
| 8 | 2 | 250 | 3.0 | 1.0 | 80 | 1.0 | $7\times10^{9}$ | −12 | o | 4 | Invention |
| 9 | 2 | 500 | 2.0 | 1.0 | 80 | 1.0 | $2\times10^{8}$ | −5 | x | 5 | Comparative |
| 10 | 2 | 250 | 2.0 | 1.0 | 40 | 1.0 | $7\times10^{9}$ | −6 | o | 5 | Invention |
| 11 | 2 | 250 | 2.0 | 1.0 | 40 | 1.5 | $7\times10^{9}$ | −6 | o | 5 | Invention |
| 12 | 3 | 250 | 2.0 | 1.0 | 80 | 1.0 | $2\times10^{12}$ | −4 | o | 1 | Comparative |

*The combined amount of gelatin in the emulsion layer side was 2.75 g/m².

As in the case of Example 1, only the samples of the invention, i.e. the samples which had a specific surface resistance of $1\times10^{9}$ to $1\times10^{12}\Omega$ on the back coating side and curled in the direction of the back coating side, could be free from the troubles of pinhole formation and jamming.

What is claimed is:

1. A silver halide photographic light-sensitive material that comprises a support having on at least one side thereof a silver halide light-sensitive emulsion layer, wherein the emulsion layer is spectrally sensitized, and a back coating layer on a side opposite the emulsion layer side, wherein the back coating layer side of said light-sensitive material has a specific surface resistance of $1\times10^{9}$ to $1\times10^{12}\Omega$ at 25° C. and 25% RH, and said light-sensitive photographic material curls in the direction of said back coating layer side;

resistance of $1\times10^{9}$ to $1\times10^{12}\Omega$ on the back coating side and curled in the direction of the back coating side, could be free from the troubles of pinhole formation and jamming.

EXAMPLE 3

Samples were prepared in substantially the same manner as in Example 1, except that the support was replaced by Support 2 that had a conductive layer. The so-prepared samples were examined in the same manner as in Example 1, and the results similar to those in Example 1 were obtained.

TABLE 3

| | Support No. | Conductive layer Aqueous conductive polymer (g/l) | BC side: BC layer Gelatin content (g/m²) | BC side: BC protective layer Gelatin content (g/m²) | BC side: BC protective layer Matting agent (mg/m²) | Emulsion layer Latex (g/m²) | Specific surface resistance (Ω) | Curing (mm) | Jamming | Pinhole | |
|---|---|---|---|---|---|---|---|---|---|---|---|
| 1 | 1 | 60 | 1.5 | 0.5 | 80 | 1.0 | $3\times10^{10}$ | 7 | x | 4 | Comparative |
| 2 | 1 | 60 | 2.0 | 0.5 | 80 | 1.0 | $3\times10^{10}$ | 4 | x | 5 | Comparative |
| 3 | 1 | 60 | 2.0 | 0.7 | 80 | 1.0 | $3\times10^{10}$ | 3 | x | 5 | Comparative |
| 4 | 1 | 60 | 2.0 | 1.0 | 80 | 1.0 | $3\times10^{10}$ | −4 | o | 5 | Invention |
| 5 | 1 | 60 | 2.2 | 0.5 | 80 | 1.0 | $3\times10^{10}$ | 3 | x | 5 | Comparative |
| 6 | 1 | 60 | 2.4 | 1.0 | 80 | 1.5 | $3\times10^{10}$ | −6 | o | 5 | Invention |
| 7 | 1 | 60 | 3.0 | 0.5 | 80 | 1.0 | $3\times10^{10}$ | −9 | o | 5 | Invention |
| 8 | 1 | 60 | 3.0 | 1.0 | 80 | 1.0 | $3\times10^{10}$ | −12 | o | 4 | Invention |
| 9 | 1 | 120 | 2.0 | 1.0 | 80 | 1.0 | $8\times10^{8}$ | −5 | x | 5 | Comparative |
| 10 | 1 | 60 | 2.0 | 1.0 | 40 | 1.0 | $3\times10^{10}$ | −6 | o | 5 | Invention |
| 11 | 1 | 60 | 2.0 | 1.0 | 40 | 1.5 | $3\times10^{10}$ | −6 | o | 5 | Invention |
| 12 | 3 | 60 | 2.0 | 1.0 | 80 | 1.0 | $2\times10^{12}$ | −4 | o | 1 | Comparative |

As in the case of Example 1, only the samples of the invention, i.e. the samples which had a specific surface said back coating layer side having an anti-static layer comprising (a) a water-soluble conductive polymer, hydrophobic polymer particles, and a hardener or (b) a metal oxide; and said light-sensitive emulsion layer comprising a hydrazine compound represented by Formula A or Formula B, or a tetrazolium compound represented by Formula T:

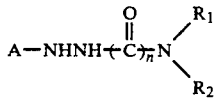

Formula A

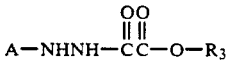

Formula B wherein A represents an aryl group or a heterocyclic group containing at least one a sulfur or oxygen atom, $R_1$ and $R_2$ each represent a hydrogen atom, an alkyl group, an alkenyl group, an alkinyl group, an aryl group, a heterocyclic group, a hydroxy group, an alkoxy group, an alkinyloxy group, an aryloxy group or a heterocyclicoxy group, $R_3$ represents an alkinyl group or a saturated heterocyclic group; n is an integer of 1 or 2;

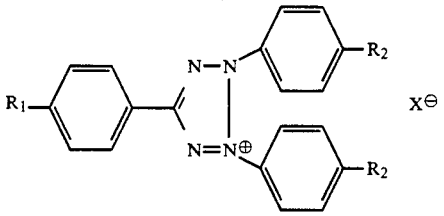

wherein $R_1$, $R_2$, and $R_3$ each represent a hydrogen or a substituent, and $X^{\ominus}$ represents an anion group; and said light-sensitive emulsion layer further contains a sensitizing dye compound represented by Formula I or IV.

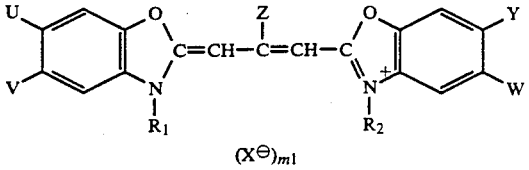

wherein $R_1$ and $R_2$ each represent a substituted or an unsubstituted alkyl group and at least one of $R_1$ and $R_2$ is a sulfoalkyl group or a carboxyalkyl group, Z represents an alkyl group or an aralkyl group, U, V, W, and Y each represent a hydrogen atom, a halogen atom, a substituted or an unsubstituted alkyl group, a substituted or an unsubstituted alkoxy group, a substituted or an unsubstituted alkoxycarbonyl group, a carboxy group or a hydroxy group, $X^{\ominus}$ represents an acid anion, and m represents 1 or 2, but when an intramolecular salt is formed, m is 1:

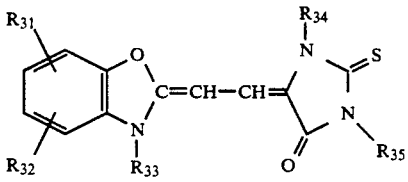

wherein $R_{31}$, $R_{32}$ represents a substituted or unsubstituted alkyl group having 1 to 8 carbon atoms, a substituted or unsubstituted alkoxy group having 1 to 8 carbon atoms, a phenyl group, a naphthyl group, a sulfo group or a sulfo group or a carboxy group or may combine with each other to form a 6-membered ring which may be substituted with a halogen atom, an alkyl group, a hydroxy group, a hydroxyalkyl group, a phenyl group, an alkoxy group, or a carboxy group, $R_{33}$ represents a substituted or unsubstituted alkyl group, a substituted or unsubstituted alkenyl group, $R_{34}$ represents a substituted or unsubstituted alkyl group having 1 to 12 carbon atoms, $R_{35}$ represents a halogen atom, a lower alkyl group, a hydroxyl group, a hydroxyalkyl group, an alkoxy group, a sulfo group, a phenyl group or a pyridyl group.

2. The material of claim 1, wherein said anti-static layer comprises a water-soluble conductive polymer, hydrophobic polymer particles and a hardener, said emulsion layer comprises said hydrozine compound and said sensitizing dye compound is represented by said Formula IV.

3. The material of claim 1, wherein said anti-static layer comprises a water-soluble conductive polymer, hydrophobic polymer particles and a hardener, said emulsion layer comprises said tetrazolium compound and said sensitizing dye compound is represented by said Formula IV.

* * * * *

UNITED STATES PATENT AND TRADEMARK OFFICE

CERTIFICATE OF CORRECTION

PATENT NO. : 5,238,800

DATED : August 24, 1993

INVENTOR(S) : Hosoi et al.

It is certified that error appears in the above-identified patent and that said Letters Patent is hereby corrected as shown below:

Item [57], col. 2,

Abstract, Title page, line 6 delete "$10^{12}\Omega$at" and insert --$10^{12}$ $\Omega$ at--.

Claim 1, column 47, line 37 after "2;" Call-Out --Formula T-- is missing;

Claim 1, column 48, line 20, on separate line beneath line 20, Call-Out --Formula IV-- is missing.

Signed and Sealed this

First Day of November, 1994

*Attest:*

*Attesting Officer*

Bruce Lehman

BRUCE LEHMAN

*Commissioner of Patents and Trademarks*